United States Patent [19]

Szarka

[11] Patent Number: 4,979,561

[45] Date of Patent: Dec. 25, 1990

[54] POSITIONING TOOL

[75] Inventor: David D. Szarka, Duncan, Okla.

[73] Assignee: Halliburton Company, Duncan, Okla.

[21] Appl. No.: 435,302

[22] Filed: Nov. 8, 1989

[51] Int. Cl.[5] ..... E21B 23/00; E21B 34/14

[52] U.S. Cl. ..... 166/240; 166/222; 166/312; 166/332

[58] Field of Search ..... 166/332, 334, 216, 217, 166/138, 134, 209, 240, 222, 223, 312

[56] References Cited

U.S. PATENT DOCUMENTS

| | | | |
|---|---|---|---|
| 2,380,022 | 7/1945 | Burt | 166/332 X |
| 2,723,677 | 11/1955 | Middleton et al. | 137/270 |
| 2,804,830 | 9/1957 | Garrett et al. | 166/332 X |
| 2,832,422 | 4/1958 | Cross, Jr. et al. | 166/216 |
| 2,924,278 | 2/1960 | Garrett et al. | 166/214 |
| 2,931,438 | 4/1960 | Thompson | 166/216 X |
| 2,965,177 | 12/1960 | LeBus, Sr. et al | 166/240 X |
| 3,051,243 | 8/1962 | Grimmer et al. | 166/332 |
| 3,073,392 | 1/1963 | Dinning et al. | 166/332 |
| 3,151,681 | 10/1964 | Cochran | 166/332 |
| 3,667,926 | 2/1964 | Alexander | 166/332 X |
| 3,703,104 | 11/1972 | Tamplen | 166/240 X |
| 3,705,624 | 12/1972 | Pitts | 166/216 |
| 3,768,562 | 10/1973 | Baker | 166/289 |
| 3,948,322 | 4/1976 | Baker | 166/289 |
| 4,364,430 | 12/1982 | Szarka | 166/214 |

OTHER PUBLICATIONS

Exhibit A—Copy of an Advertising Brochure of Baker-Hughes, Inc., entitled, "Horizontal Completion Problems Baker-Hughes Solutions", (publication date unknown).

*Primary Examiner*—Stephen J. Novosad

*Attorney, Agent, or Firm*—James R. Duzan; L. Wayne Beavers

[57] ABSTRACT

A positioning tool apparatus for positioning a sliding member of a well tool includes a drag assembly having a longitudinal passageway defined therethrough. An inner mandrel is disposed through the longitudinal passageway of the drag assembly and is longitudinally movable relative to the drag assembly. An operating assembly is provided for selectively operably engaging the sliding member of the well tool in response to longitudinally reciprocating motion of the inner mandrel relative to the drag assembly.

35 Claims, 12 Drawing Sheets

POSITIONING TOOL

BACKGROUND OF THE INVENTION

1. Field Of The Invention

The present invention relates to positioning tools for positioning a sliding member of a well tool such as a casing valve, and more particularly, but not by way of limitation, to a positioning tool particularly suited for use with casing valves in wells having substantially non-vertical deviated portions such as occurs in horizontal drilling.

2. Brief Description Of The Prior Art

It is known that sliding sleeve type casing valves can be placed in the casing of a well to provide selective communication between the casing bore and subsurface formations adjacent the casing valve. One such casing valve is shown in U.S. Pat. No. 3,768,562 to Baker, assigned to the assignee of the present invention. The Baker '562 patent also discloses a positioning tool for actuating the sliding sleeve of the casing valve.

U.S. patent application Ser. No. 231,737 to Brandell, now U.S. Pat. No. 4,880,059, and also assigned to the assignee of the present invention, discloses the use of sliding sleeve casing valves utilizing a positioning tool for actuation thereof in the deviated portion of a well.

The present invention provides improvements in positioning tools for engaging and operating the sliding sleeve of a casing valve or other similar well tools.

SUMMARY OF THE INVENTION

A positioning tool apparatus for positioning a sliding member of a well tool, such as a sliding sleeve of a casing valve, includes a drag assembly having a longitudinal passageway defined therethrough. An inner mandrel is disposed through the longitudinal passageway of the drag assembly and is longitudinally movable relative to the drag assembly. The tool includes an operating means for selectively operably engaging the sliding sleeve of the casing valve in response to longitudinally reciprocating motion of the inner mandrel relative to the drag assembly.

The operating means includes a plurality of opening blocks disposed on one end of the drag assembly and a plurality of closing blocks disposed on the other end of the drag assembly. The operating means also includes a pair of annular wedges attached to the inner mandrel with the drag assembly and opening and closing blocks located therebetween. Upon reciprocation of the inner mandrel a selective one of the wedges engages either the opening blocks or closing blocks to cam them outward into operative engagement with the sliding sleeve of the casing valve.

The operating means also includes a J-slot and lug means interconnecting the inner mandrel and the drag assembly for selectively permitting the mandrel to move relative to the drag assembly through a repetitive pattern of longitudinal positions of the mandrel relative to the drag assembly. The repetitive pattern of positions includes one position wherein the opening blocks are cammed outward, another position wherein the closing blocks are cammed outward, and two intermediate positions through which the mandrel must pass between its opening and closing positions. In the intermediate positions, the opening and closing blocks are not biased outwardly, and thus the positioning tool can freely pass through the casing valve.

Numerous objects, features and advantages of the present invention will be readily apparent to those skilled in the art upon a reading of the following disclosure when taken in conjunction with the accompanying drawings.

BRIEF DESCRIPTION OF THE DRAWINGS

FIG. 6 is a view similar to FIG. 1, after the well has been fractured adjacent each of the casing valves. A stimulation tool string is shown in place in the well.

DETAILED DESCRIPTION OF THE PREFERRED EMBODIMENTS

Figure 1:
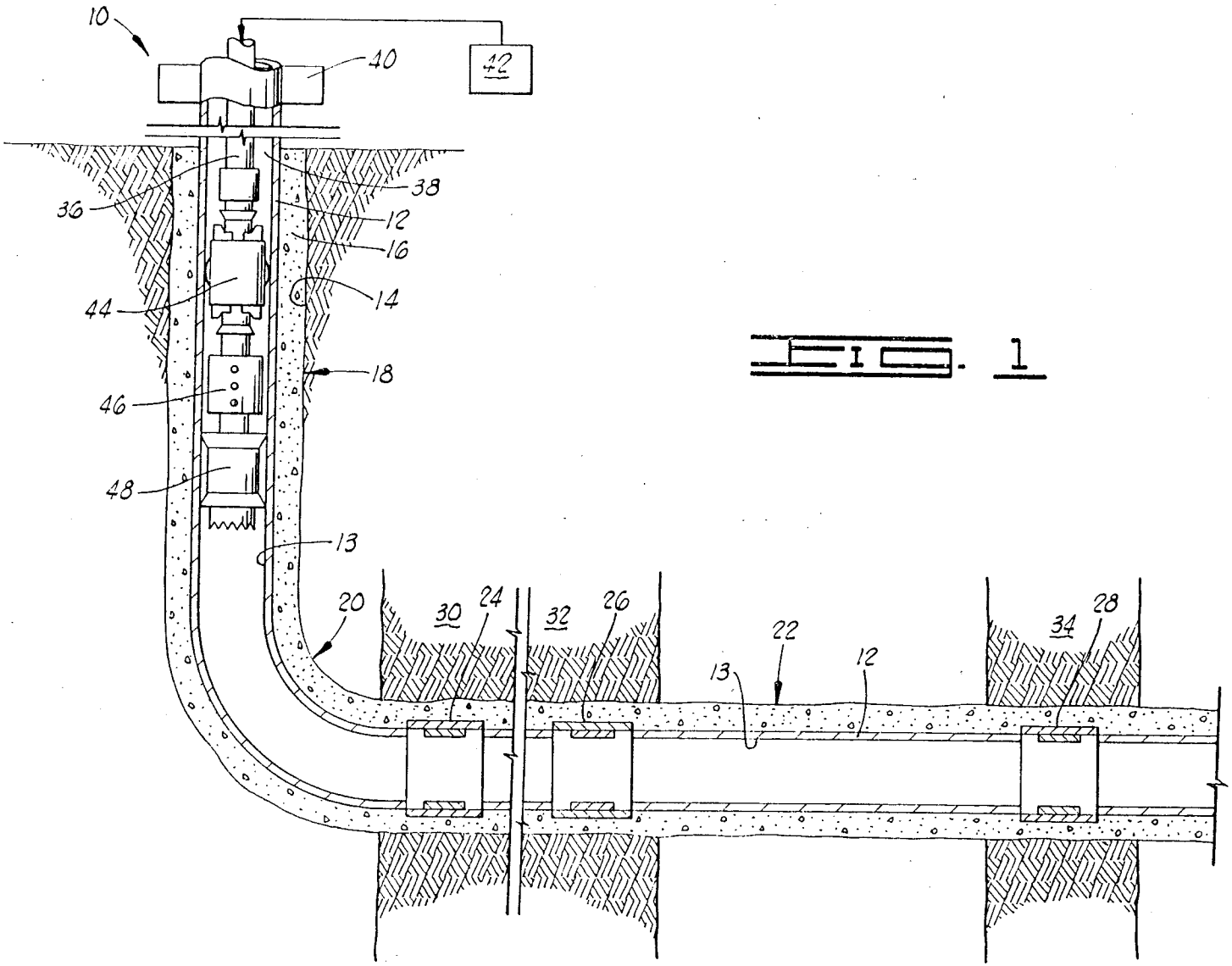
FIG. 1 is a schematic elevation sectioned view of a well having a substantially deviated well portion. A work string is being run into the well including a positioner means, a jetting tool assembly, and a wash tool. The deviated portion of the well has multiple casing valves placed in the casing string.
Figure 2A:
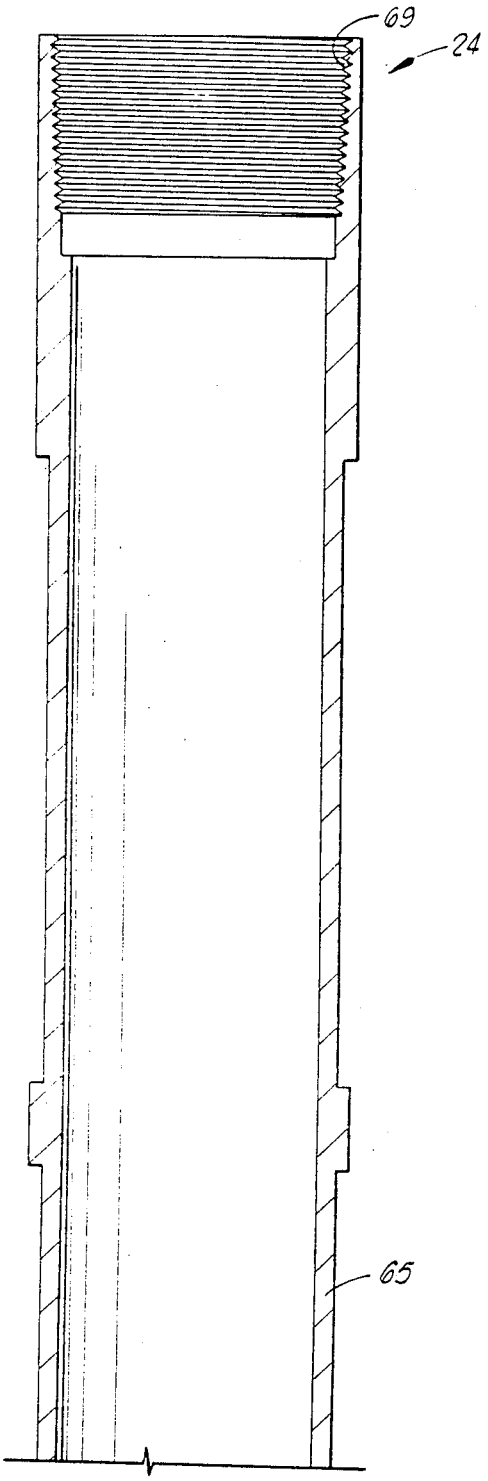
FIGS. 2A–2D comprise an elevation sectioned view of the casing valve. The sleeve is in a closed position and the sleeve ports and housing ports are plugged.
Figure 2B:
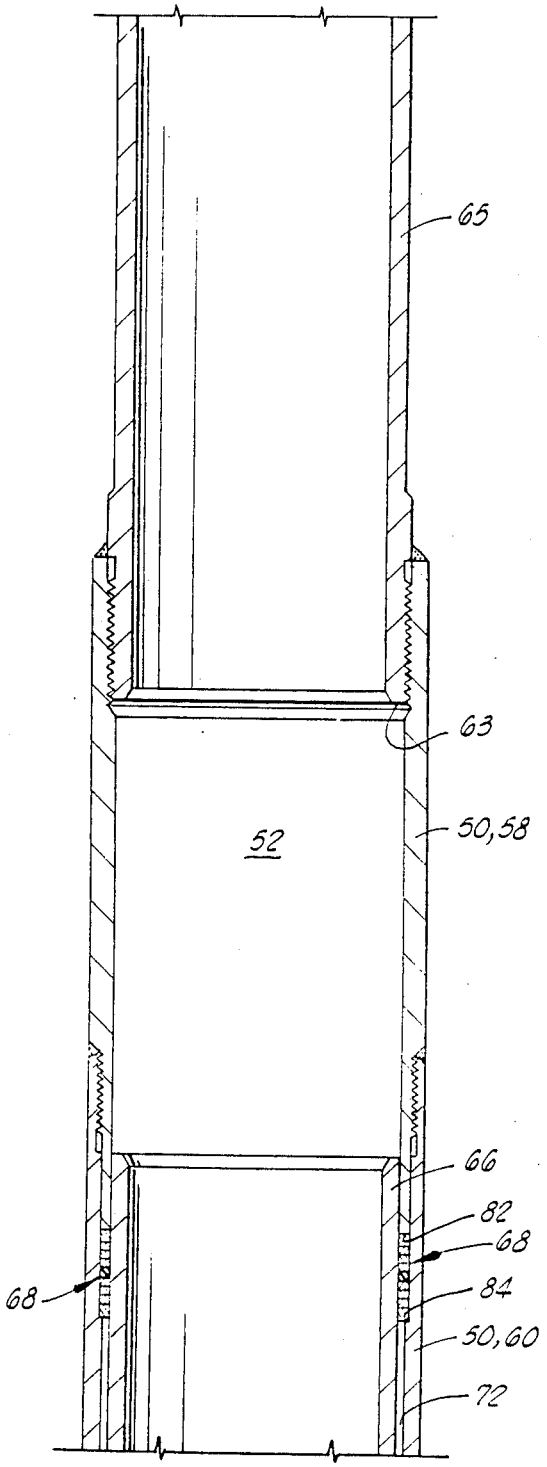
Figure 2C:
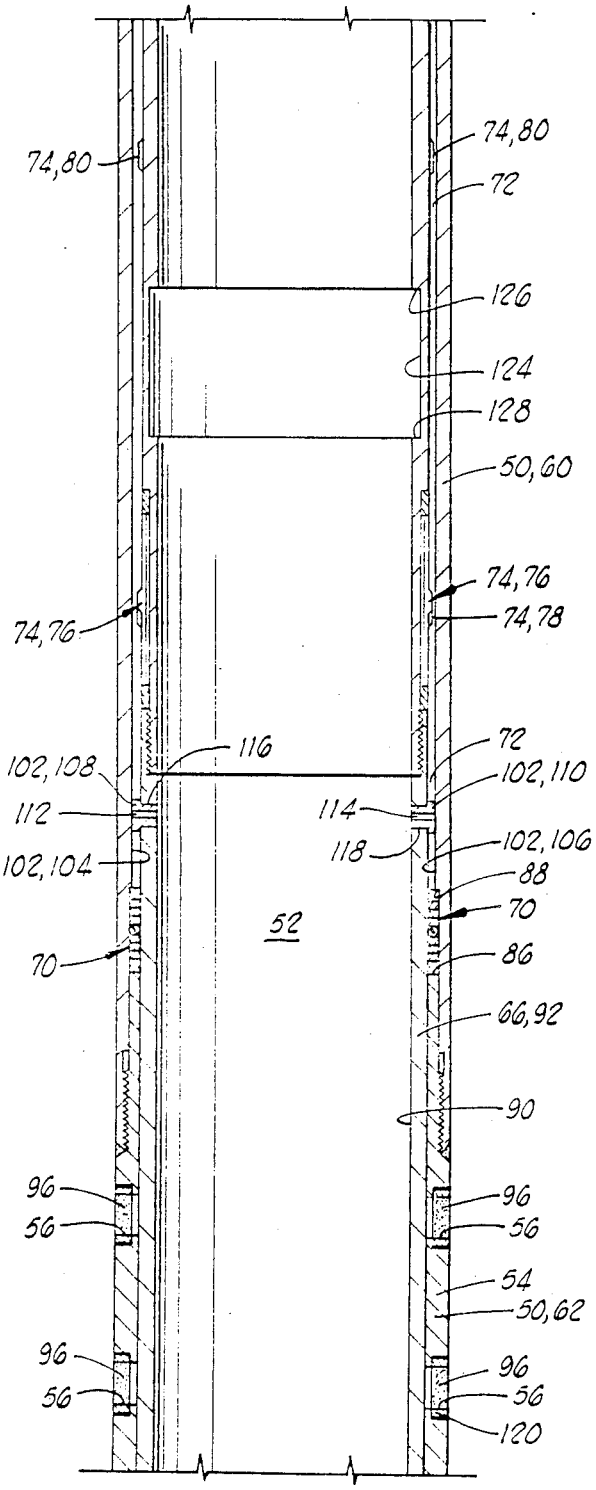
Figure 2D:
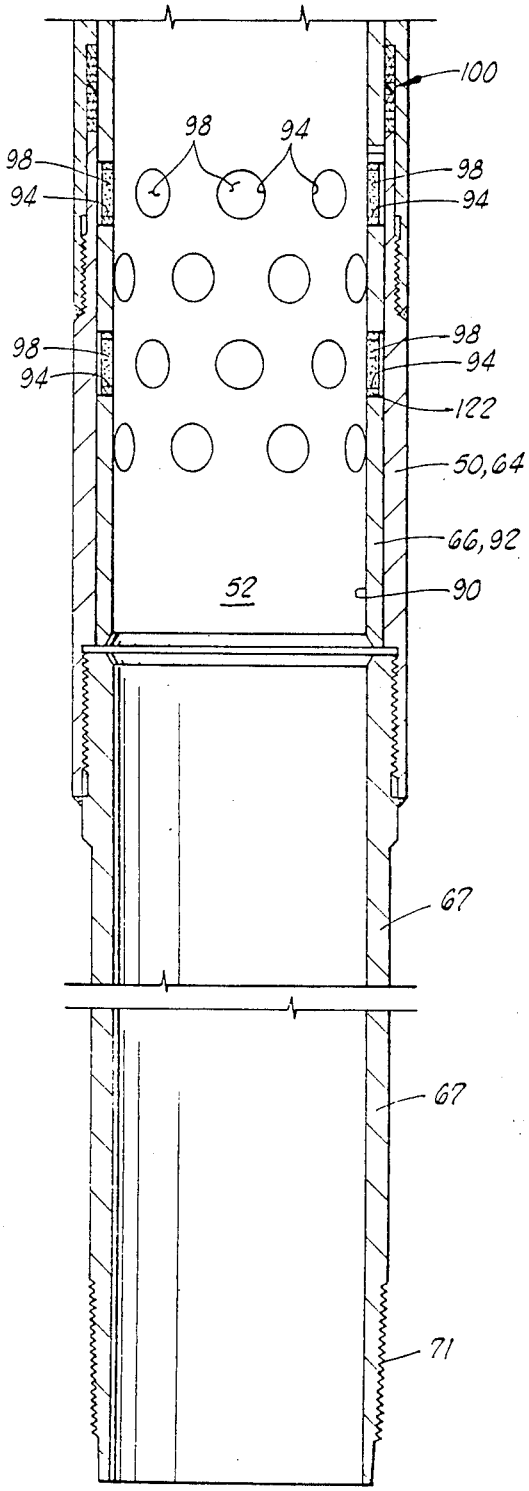

Referring now to the drawings, and particularly to FIG. 1, a well is shown and generally designated by the numeral 10. The well 10 is constructed by placing a casing string 12 in a borehole 14 and cementing the same in place with cement as indicated at 16. The casing string may be in the form of a liner instead of the full casing string 12 illustrated. Casing string 12 has a casing bore 13.

The well 10 has a substantially vertical portion 18, a radiused portion 20, and a substantially non-vertical deviated portion 22 which is illustrated as being a substantially horizontal well portion 22. Although the tools described herein are designed to be especially useful in the deviated portion of the well, they can of course also be used in the vertical portion of the well.

Spaced along the deviated well portion 22 of casing 12 are a plurality of casing valves 24, 26, and 28. The casing valve 24, which is identical to casing valves 26 and 28, is shown in detail in FIGS. 2A–2D. Each of the casing valves is located adjacent a subsurface zone or formation of interest such as zones 30, 32, and 34, respectively.

In FIG. 1, a tubing string 36 having a plurality of tools connected to the lower end thereof is being lowered into the well casing 12. A well annulus 38 is defined between tubing string 36 and casing string 12. A blowout preventer 40 located at the surface is provided to close the well annulus 40. A pump 42 is connected to tubing string 36 for pumping fluid down the tubing string 36.

The tubing string 36 shown in FIG. 1 has a positioner tool apparatus 44, a jetting tool apparatus 46, and a wash tool apparatus 48 connected thereto. This tool string is shown in detail in FIGS. 3A-3E.

The Casing Valve

The casing valve 24, which may also generally be referred to as a sliding sleeve casing tool apparatus 24, is shown in detail in FIGS. 2A-2D. Casing valve 24 includes an outer housing 50 having a longitudinal passageway 52 defined therethrough and having a side wall 54 with a plurality of housing communication port 56 defined through the side wall 54.

The outer housing 50 is made up of an upper housing portion 58, a seal housing portion 60, a ported housing section 62, and a lower housing section 64. Upper and lower handling subs 65 and 67 are attached to the ends of housing 50 to facilitate handling and makeup of the sliding sleeve casing tool 24 into the casing string 12. Subs 65 and 67 are threaded at 69 and 71, respectively, for connection to casing string 12.

The casing valve 24 also includes a sliding sleeve 66 slidably disposed in the longitudinal passageway 52 of housing 50. Sleeve 66 is selectively movable relative to the housing 50 between a first position as shown in FIGS. 2A-2D blocking or covering the housing communication ports 56 and a second position illustrated in FIGS. 4A-4E wherein the housing communication ports 56 are uncovered and are communicated with the longitudinal passageway 52.

The casing valve 24 also includes first and second longitudinally spaced seals 68 and 70 disposed between the sliding sleeve 66 and the housing 50 and defining a sealed annulus 72 between the sliding sleeve 66 and the housing 50. The first and second seals 68 and 70 are preferably chevron type packings. This style of packing will provide a long life seal that is less susceptible to cutting and/or wear by entrapped abrasive materials such as frac sand and formation fines than are many other types of seals.

A position latching means 74 is provided for releasably latching the sliding sleeve 66 in its first and second positions. The position latching means 74 is disposed in the sealed annulus 72.

The position latching means 74 includes a spring collet 76 which may also be referred to as a spring biased latch means 76 attached to the sliding sleeve 66 for longitudinal movement therewith.

The position latching means 74 also includes first and second radially inward facing longitudinally spaced grooves 78 and 80 defined in the housing 50 and corresponding to the first and second positions, respectively, of the sliding sleeve 66.

By placing the spring collet 76 in the sealed annulus 72 the collet is protected in that cement, sand and the like are prevented from packing around the collet and impeding its successful operation.

It is noted that the position latching means 74 could also be constructed by providing a spring latch attached to the housing and providing first and second grooves in the sliding sleeve 66 rather than vice versa as they have been illustrated.

The first chevron packing type seal 68 is held in place between a lower end 82 of upper housing portion 58 and an upward facing annular shoulder 84 of seal housing portion 60.

The second chevron type seal 70 is held in place between an upper end 86 of ported housing section 62 and a downward facing annular shoulder 88 of seal housing section 60.

The sliding sleeve 66 has a longitudinal sleeve bore 90 defined therethrough and has a sleeve wall 92 with a plurality of sleeve communication ports 94 defined through the sleeve wall 92.

All of the housing communication ports 56 and sleeve communication ports 94 have disintegratable plugs 96 and 98, respectively, initially blocking the housing communication ports 56 and the sleeve communication ports 94.

The disintegratable plugs 96 and 98 are preferably constructed from threaded hollow aluminum or steel insert rings 120 and 122, respectively, filled with a material such as Cal Seal, available from U.S. Gypsum, which can be removed by hydraulic jetting as is further described below.

By initially providing the communication ports 56 and 94 with the disintegratable plugs 96 and 98, cement and other particulate material is prevented from entering the ports and getting between the sliding sleeve 66 and housing 50.

In the first position of sleeve 66 relative to housing 50 as shown in FIGS. 2A-2D, the housing communication ports 56 and the sleeve communication ports 94 are out of registry with each other, and a third chevron type seal packing 100 between sleeve 66 and housing 50 isolates the sleeve communication ports 94 from the housing communication ports 56.

The sleeve 66 is selectively movable relative to the housing 50 between the first position of FIGS. 2A-2D to the second position shown in FIGS. 4A-4E wherein the housing communication ports 56 are in registry with respective ones of the sleeve communication ports 94.

An alignment means 102 is operably associated with the housing 50 and sliding sleeve 66 for maintaining the sleeve communication ports 94 in registry with the housing communication ports 56 when the sleeve 66 is in its said second position with spring collet 76 engaging groove 80. The alignment means 102 includes a plurality of longitudinal guide grooves such as 104 and 106 disposed in the housing 50, and a plurality of corresponding lugs 108 and 110 defined on the sliding sleeve 66 and received in their respective grooves 104 and 106.

The alignment means 102 is located in the sealed annulus 72 defined between first and second seals 68 and 70.

The lugs 108 and 110 preferably have weep holes 112 and 114 defined therethrough communicating the sleeve bore 90 with the sealed annulus 72 so as to pressure balance the first and second seals 68 and 70. The lugs 108 and 110 are preferably cylindrical pins which are threadedly engaged with radial bores 116 and 118 defined through the sleeve wall 92.

It is noted that the casing valve 24 could also be constructed so as to have lugs or pins attached to housing 50 and received in longitudinal grooves defined in sliding sleeve 66 in order to provide alignment between the housing communication ports 56 and the sleeve communication ports 96.

The sliding sleeve 66 of casing valve 24 has a comparatively short sleeve travel as compared to sliding sleeve type casing valves of the prior art. In one embodiment of the casing valve 24, a sleeve travel of only 10.75 inches was required.

The sliding sleeve 66 has an enlarged internal bore 124 defined between an upper downward facing shoulder 126 and a lower upward facing shoulder 128. As further defined below, the positioning tool 44 will engage the upper shoulder 126 to pull the sleeve 66 upward, and it will engage the lower shoulder 128 to pull the sleeve downward.

The Positioning Tool

Turning now to FIGS. 3A–3E, a tool string is thereshown made up of the positioning tool 44, the jetting tool 46, and the wash tool 48. These same components are shown in place within the casing valve 24 in the casing string 12 in FIGS. 4A–4E.

The positioning tool apparatus 44 may be generally described as a positioning tool apparatus for positioning a sliding member of a well tool, such as the sliding sleeve 66 of casing valve 24.

The primary components of the positioning tool apparatus 44 are a drag assembly 130, an inner positioning mandrel 132, and an operating means 134.

The drag assembly 130 includes a lug housing section 136 connected to a drag block housing section 138 at threaded connection 140. A plurality of radially outwardly biased drag blocks 142 and 144 are carried by the drag block housing section. The drag assembly 130 has a longitudinal passageway 146 defined through the lug housing section 136 and drag block housing section 138.

The positioning mandrel 132 is disposed through the longitudinal passageway 146 of drag assembly 130 and is longitudinally movable relative to the drag assembly 130, that is the positioning mandrel 132 can slide up and down within the longitudinal passageway 146. The positioning mandrel 132 has a star guide or centralizer 133 attached thereto for centralizing the positioning tool 44 within the casing valve 24 or the casing string 12.

The operating means 134 provides a means for selectively operably engaging the sliding sleeve 66 of casing valve 24 in response to longitudinally reciprocating motion of the positioning mandrel 132 relative to the drag assembly 130.

More particularly, the operating means 134 includes an engagement means 148 connected to the drag assembly 130 for operably engaging the sliding sleeve 66 of casing valve 24. Operating means 134 also includes an actuating means 150 connected to the positioning mandrel 132 for actuating the engagement mean 148 so that the engagement means 148 can operably engage the sliding sleeve 66 of casing valve 24. The operating means 134 also includes a position control means 152 operably associated with the drag assembly 130 and positioning mandrel 132 for permitting the positioning mandrel 132 to reciprocate longitudinally relative to the drag assembly 130 and selectively actuate and unactuate the engagement means 148 with the actuating means 150.

The engagement means 148 includes a first plurality of engagement blocks 154 circumferentially spaced about a longitudinal axis 156 of drag assembly 130, with each of the engagement blocks 154 having a tapered camming surface 160 defined on one end thereof, and each of the blocks 154 also having an engagement shoulder 162 defined thereon and facing away from the end having the tapered camming surface 160. It will be understood that the engagement blocks 154 are segmented blocks which are placed in an annular pattern about the positioning mandrel 132. A first biasing means comprised of a plurality of leaf type springs 164 connect the first plurality of blocks 154 to the upper end of lug housing section 136 of drag means 130 for resiliently biasing the first plurality of blocks 154 radially inward toward the longitudinal axis 156 of the drag assembly 130.

The engagement means 148 further includes a second plurality of engagement blocks 166 similarly located adjacent the lower end of drag block housing section 138. Each of the second blocks 166 has a tapered camming surface 168 defined on one end thereof facing away from the first plurality of blocks 154. Each of the blocks 166 has an engagement shoulder 170 defined thereon and facing toward the first plurality of engagement blocks 154. Engagement means 148 also includes a second biasing means 172 made up of a plurality of leaf springs each of which connects one of the second plurality of blocks 166 to the drag block housing section 138 so that the second plurality of blocks 166 is resiliently biased radially inward toward the longitudinal axis 156 of the drag assembly 130.

Generally speaking the engagement means 148 can be said to include separate first and second engagement means, namely the first and second pluralities of engagement blocks 154 and 166, respectively.

The actuating means 150 includes upper and lower annular wedges 174 and 176, respectively.

First annular wedge 174 includes a tapered annular wedging surface 178 complementary to the tapered camming surfaces 160 of the first plurality of engagement blocks 154. The annular wedge 174 is positioned on the positioning mandrel 132 so that when the positioning mandrel 132 is moved downward from the position illustrated in FIGS. 3A–3E to a first longitudinal position relative to the drag assembly 130, the annular wedging surface 178 will wedge against the tapered camming surfaces 160 and bias the blocks 154 radially outward.

The second annular wedge 176 similarly has a tapered annular wedging surface 180 complementary to the tapered camming surfaces 168 of the second plurality of blocks 166.

The tapered annular wedging surfaces 178 and 180 of the first and second annular wedges 174 and 176 face toward each other with the first and second pluralities of engagement blocks 154 and 166 being located therebetween.

The position control means 152 includes a J-slot 182 defined in the positioning mandrel 132, and a plurality of lugs 184 and 186 connected to the drag assembly 130, with the lugs 184 and 186 being received in the J-slot 182. Generally speaking the J-slot can be said to be defined in one of the positioning mandrel 132 and the drag assembly 130, with the lug being connected to the other of the positioning mandrel 132 and the drag assembly 130. The J-slot 182 could be defined in the drag assembly 130, with the lugs 184 being connected to the positioning mandrel 132.

Figure 5:
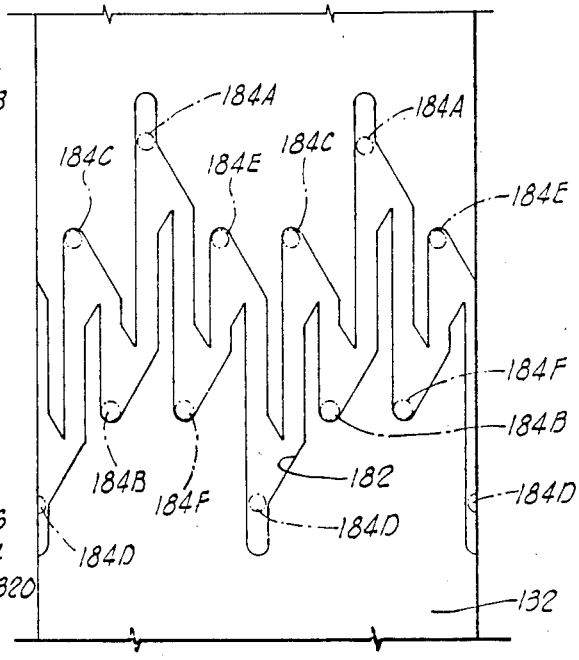
FIG. 5 is a laid out view of a J-slot and lug means located in the positioner tool.
Figure 5:
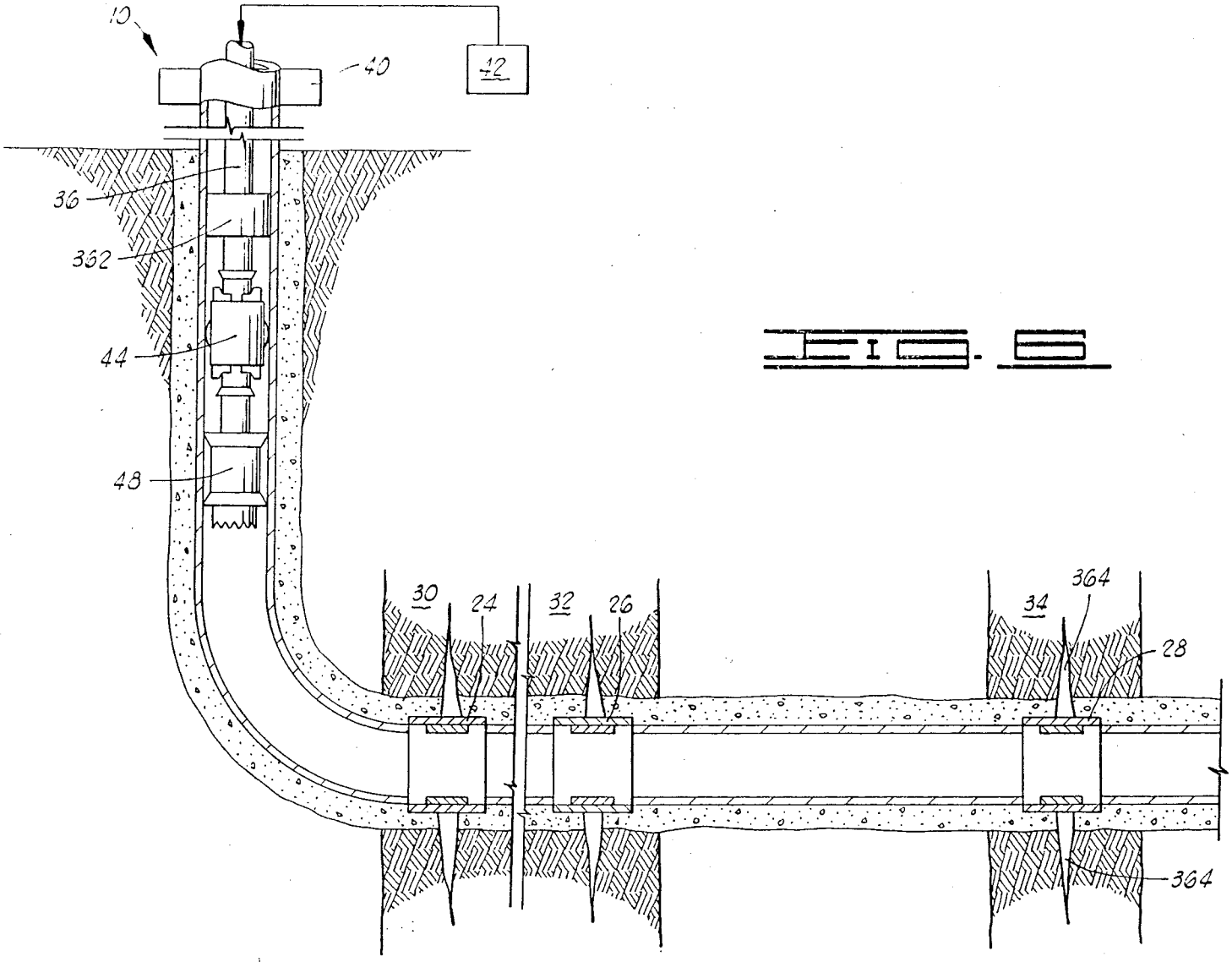

The J-slot 182 is best seen in the laid out view of FIG. 5. J-slot 182 is an endless J-slot.

Referring back to FIG. 3B, the lugs 184 and 186 are mounted in a rotatable ring 188 sandwiched between the lug housing section 136 and drag block housing section 138 with bearings 190 and 192 being located at the upper and lower ends of rotatable ring 188. This permits the lugs 184 and 186 to rotate relative to the J-slot 182 as the positioning mandrel 132 is reciprocated or moves longitudinally relative to the drag assembly 130 so that the lugs 184 and 186 may traverse the endless J-slot 182.

The J-slot 182 and lugs 184 and 186 of position control means 152 interconnect the positioning mandrel 132 and the drag means 130 and define at least in part a repetitive pattern of longitudinal positions of positioning mandrel 132 relative to the drag assembly 130 achievable upon longitudinal reciprocation of the positioning mandrel 132 relative to the drag assembly 130. That repetitive pattern of positions is best illustrated with reference to FIG. 5 in which the various positions of lug 184 are shown in phantom lines.

Beginning with one of the positions designated as 184A, that position corresponds to a position in which the upper annular wedge 174 would have its wedging surface 178 engaged with the first plurality of blocks 154 to cam them outwards so that their shoulders 162 could engage shoulder 128 of sliding sleeve 66 so as to pull the sliding sleeve 66 downward within casing valve housing 50 to move the sliding sleeve 66 to a closed position as illustrated in FIGS. 2A–2D. Thus blocks 154 can be referred to as closing blocks. As is apparent in FIG. 5, in this first position 184A the position is not defined by positive engagement of the lug 184 with an extremity of the groove 182, but rather the position is defined by the engagement of the upper wedge 174 with the upper blocks 154.

By then pulling the tubing string 36 and positioner mandrel 132 upward, with the drag assembly 130 being held in place by the frictional engagement of drag blocks 142 and 144 with the casing string 12 or casing valve 24, the J-slot 182 will be moved upward so that the lug 184 traverses downward and over to the position 184B seen in FIG. 5. In position 184B, which can be referred to as an intermediate position, the lug 184 is positively engaged with an extremity of J-slot 182 and allows the drag means 130 to be moved upwardly in common with the positioner mandrel 132 with both sets of engagement blocks 154 and 156 in an unengaged position as seen in FIGS. 3B–3C so that the positioning tool 44 can be pulled upwardly out of the casing valve 24 without operatively engaging its sliding sleeve 66.

The next downward stroke of positioning mandrel 132 relative to drag means 130 moves the lug to position 184C which is another intermediate position in which lug 184 is positively engaged with another extremity of groove 182 so that the positioning mandrel 132 and drag means 130 can be moved downwardly together through casing string 12 and casing valve 24 without actuating either the upper blocks 154 or lower blocks 166.

Figure 4A:
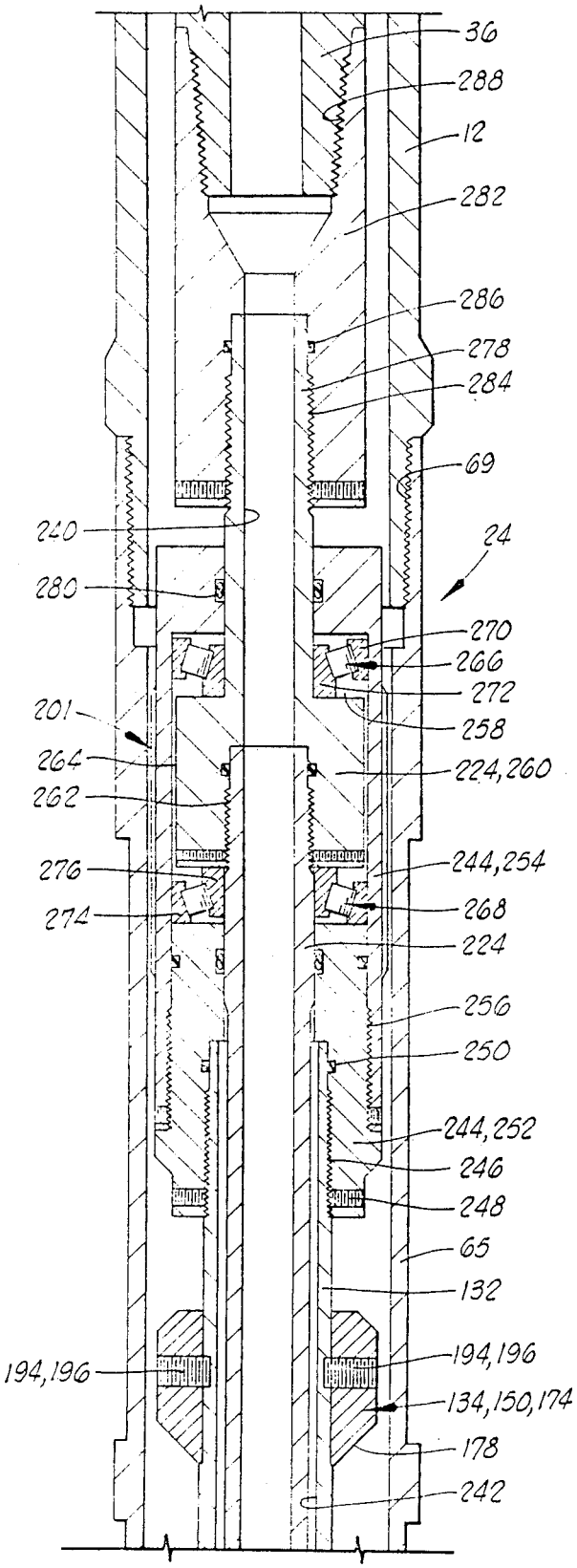
FIGS. 4A–4E comprise an elevation sectioned view of the tool string of FIGS. 3A–3E in place within the casing valve of FIGS. 2A–2D. The sleeve has been moved to an open position and the plugs have been jetted out of the sleeve ports and housing ports.
Figure 4B:
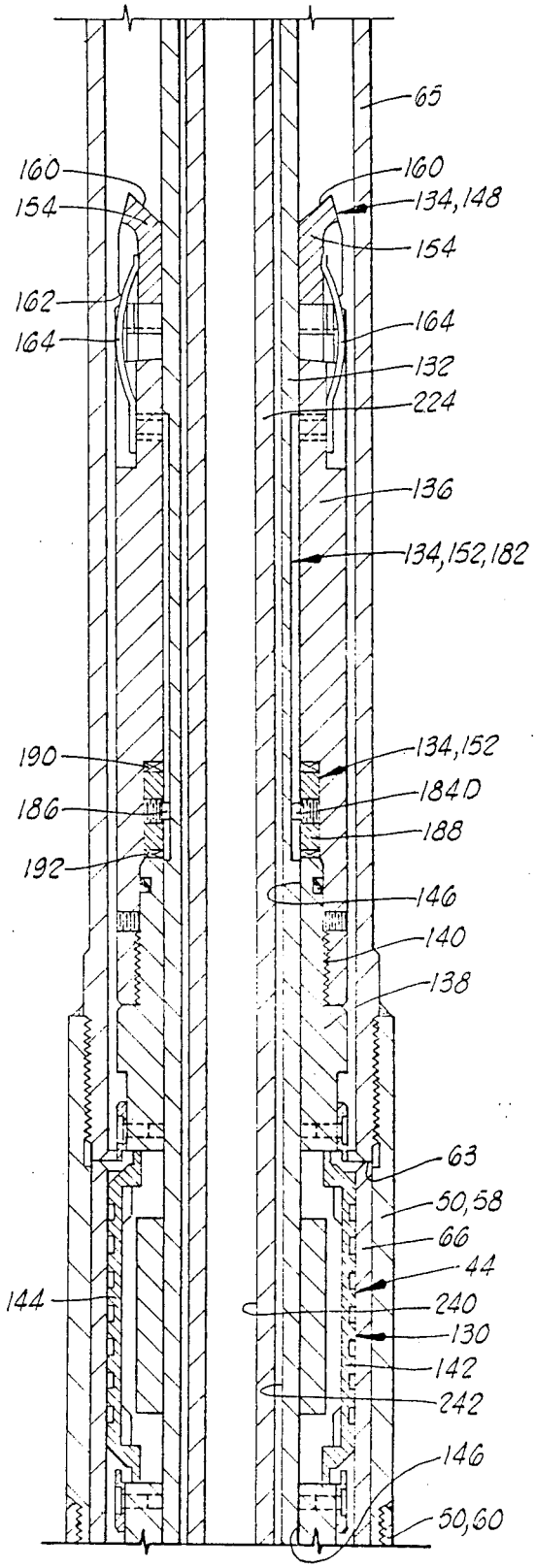
Figure 4C:
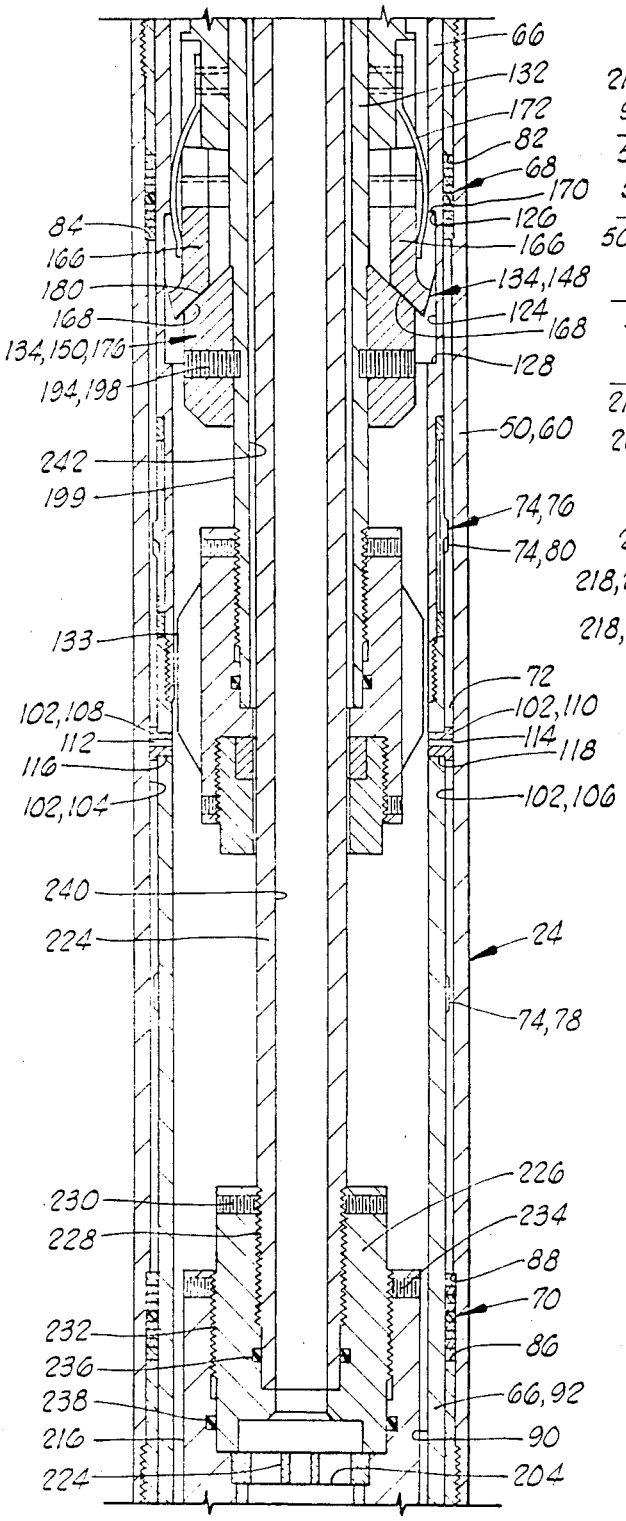

On the next upward stroke of positioning mandrel 132 relative to drag means 130, the lug 184 moves to the position 184D which is in fact defined by engagement of the lower annular wedge 176 with the lower set of engagement blocks 166 so that they are cammed outward to operably engage shoulder 126 of sliding sleeve 66 of casing valve 24 as is illustrated in FIG. 4C. On this upward stroke the sleeve valve 66 can be pulled up to an open position. Thus blocks 166 can be referred to as opening blocks.

The next downward movement of positioning mandrel 132 relative to drag means 130 moves the lug to position 184E which is in fact a repeat of position 184C insofar as the longitudinal position of mandrel 132 relative to drag means 130 is concerned. The next upward motion of positioning mandrel 132 moves the lug to position 184F which is a repeat of the position 184B insofar as longitudinal position of positioning mandrel 132 relative to drag means 130 is concerned.

Then, the next downward motion of positioning mandrel 132 relative to positioning means 130 moves the lug back to position 184A in which the upper wedge 178 will engage the upper blocks 154 to cam them outwards to that the sliding sleeve 66 may be engaged and moved downward within the casing valve 124.

The positioning tool 44 further includes an emergency release means 194 operatively associated with each of the first and second actuating means 174 and 176 for releasing the first and second engagement means 154 and 166 from operative engagement with the sliding sleeve 66 without moving the positioning mandrel 132 to one of the intermediate positions such as 184B, 184C, 184E or 184F. This emergency release means 194 includes first and second sets of shear pins 196 and 198 connecting the first and second actuating wedges 174 and 176, respectively, to the positioning mandrel 132. For example, if the positioning tool 44 is in position corresponding to lug position 184D as shown in FIGS. 4A–4E, with the lower engagement blocks 166 cammed outward and in operative engagement with the sliding sleeve 66, and the position control means 152 becomes disabled as for example by jamming of the lug and J-slot, then a sufficient upward pull on the tubing string 36 will shear the shear pins 198 thus allowing the lower annular wedge 176 to slide downward along an outer surface 199 of positioning mandrel 132 so that the wedge 176 is pulled away from the lower engagement blocks 166 allowing them to bias inwardly out of engagement with the sliding sleeve 66.

Figure 8:
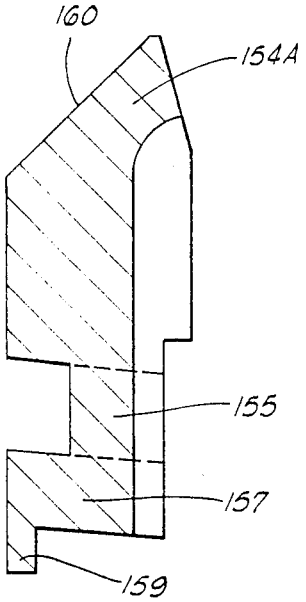
FIGS. 8 and 9 are side and front elevation views of a modified engagement block.
Figure 9:
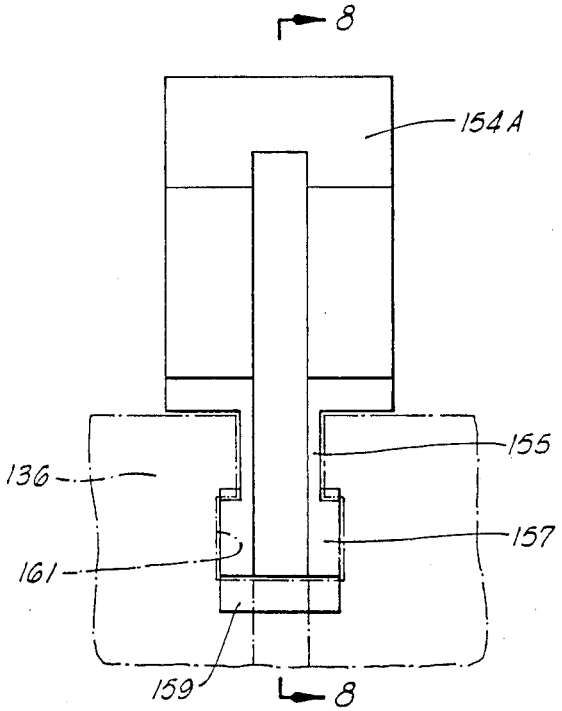
Figure 10:
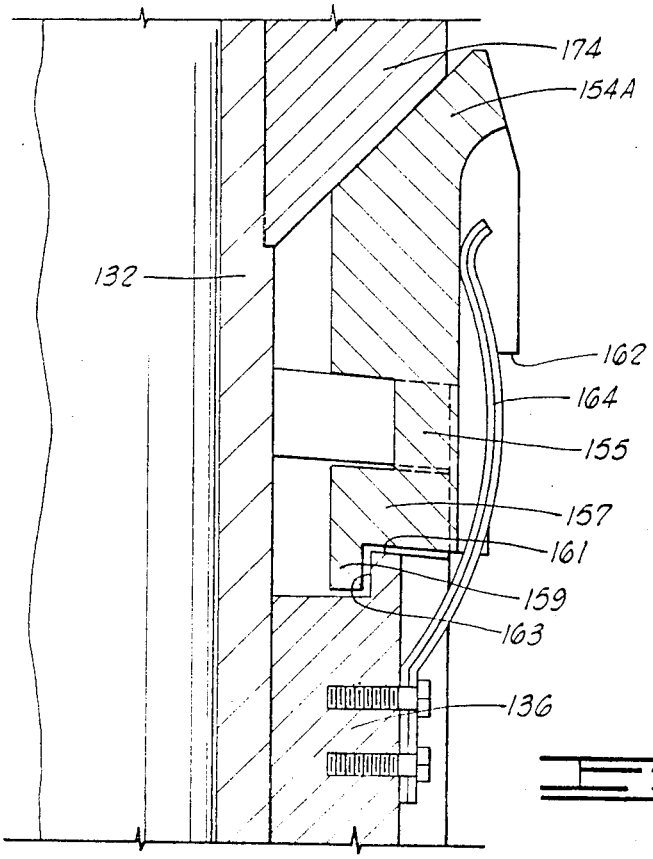
FIG. 10 is an elevation section view of the engagement block of FIGS. 8 and 9 in place in the positioning tool.

FIGS. 8, 9 and 10 show an alternative embodiment for the engagement blocks such as upper engagement block 154. FIG. 8 is a side elevation view of a modified engagement block 154A. FIG. 9 is a front elevation view of the modified engagement block 154A. FIG. 10 is an elevation sectioned view of the modified block 154A as assembled with the surrounding portions of the positioning tool 44.

In FIGS. 8 and 9, it is seen that the engagement block 154A includes an inverted T-shaped lower portion having a stem 155 and a cross bar 157. A safety retainer lip 159 extends down from the rear edge of the cross bar 157.

The inverted T-shaped portion 155, 157 is received in an inverted T-shaped slot 161 defined in lug housing section 136 as best shown in phantom lines in FIG. 9.

As best seen in FIG. 10, the lug housing section 136 has an internal undercut 163 therein just below the slots such as 161, which is dimensioned so as to abut the retaining lip 159 in the radially outermost position of block 154A.

The retaining lip 159 and associated structure of lug housing section 136 function together as a safety retainer means for maintaining a connection between the engagement block 154A and the lug housing section 136 of the drag assembly 130 in the event the leaf spring 164 breaks. Thus, if the leaf spring 164 breaks, the engagement block 154A can not fall out of assembly with the remainder of the drag assembly 44. Instead, due to the interlocking effect of the T-shaped portion 155, 157 in T-shaped slot 161 along with the retainer lip 159, the engagement block 154A will remain in place.

Due to the retaining lip 159, the engagement block 154A must be assembled with the lug housing section 136 by sliding the engagement block 154A into the T-shaped slot 161 from the inside of the lug housing section 136.

The Jetting Tool

The jetting tool 46 can be generally described as an apparatus for hydraulically jetting a well tool such as casing valve 24 disposed in the well 10.

The construction of the jetting tool 46 is very much associated with that of the positioning tool 44. When the positioning tool 44 engages the sliding sleeve 66 of casing valve 24 and moves it to an open position, the dimensions of the positioning tool 44 and the jetting tool 46 will cause the jetting tool 46 to be appropriately aligned for hydraulically jetting the disintegratable plugs found in the casing valve.

The jetting tool 46 can be generally described as a jetting means 46, connected at a rotatable connection defined by a swivel 201 to the positioning tool 44 so that the jetting means 46 is rotatable relative to the positioning tool 44 and the casing valve 24. Thus, the jetting tool 46 can hydraulically jet the disintegratable plugs from the casing valve 24 as the jetting tool 46 is rotated relative to the positioning tool 44 and the casing valve 24.

The jetting tool 46 includes a jetting sub 200 having a chamber 202 defined therein with open upper and lower ends 204 and 206, respectively. The sub 200 has a peripheral wall 208 with a plurality of jetting orifices 210 defined therethrough and communicated with chamber 202. Each of the jetting orifices 210 is defined in a threaded insert 212 set in a recessed portion 214 of a cylindrical outer surface 216 of the jetting sub 200.

A check valve means 218 is disposed in the lower end of chamber 202 for freely permitting upward fluid flow through chamber 202 and for preventing downward fluid flow out the lower end 206 of chamber 202 so that a downward fluid flow through the chamber 202 is diverted through the jetting orifices 210.

The check valve means 218 includes a seat 220 defined in the open lower end 206 of chamber 202 and a ball valve member 222 dimensioned to sealingly engage the seat 220. The ball valve member 222 is free to move up into the chamber 202.

The jetting sub 200 further includes a ball retainer 224 in the open upper end 204 of sub 200 to prevent the ball valve member 222 from being carried out of the chamber 202 by upwardly flowing fluid.

The check valve permits the tubing string 36 to fill while running into the well 10, as well as permitting reverse circulation through the wash tool 48. Additionally, the ball 222 is self centered to facilitate easy seating thereof when the jetting tool 46 is in a horizontal position such as in the deviated portion 22 of the well 10.

The wash tool 48 located below jetting tool 46 is also operationally associated with the jetting tool 46 as is further described below. The wash tool 48 can be generally described as a wash means 48 located below the positioning tool 44 and the jetting tool 46 for washing the bore of casing string 12 while reverse circulating down the well annulus 38 and up through the wash tool 48 and the jetting tool 46.

Figure 3A:
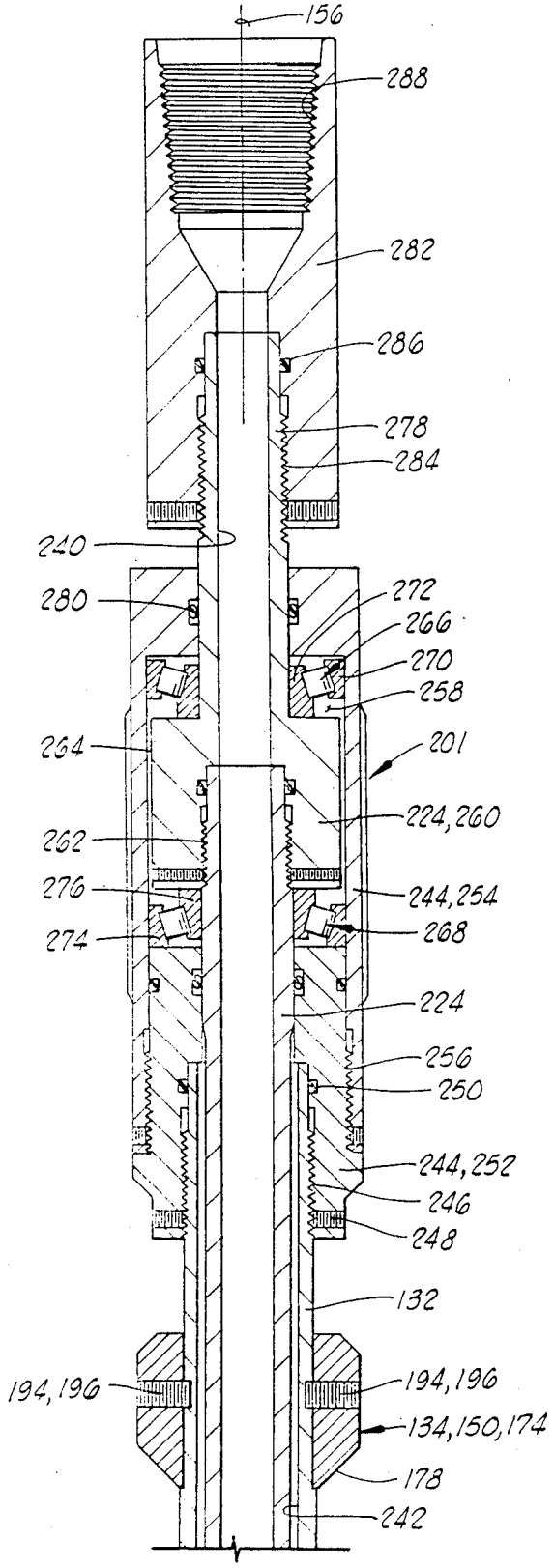
FIGS. 3A–3E comprise an elevation sectioned view of the positioner tool, the jetting tool, and the wash tool.
Figure 3B:
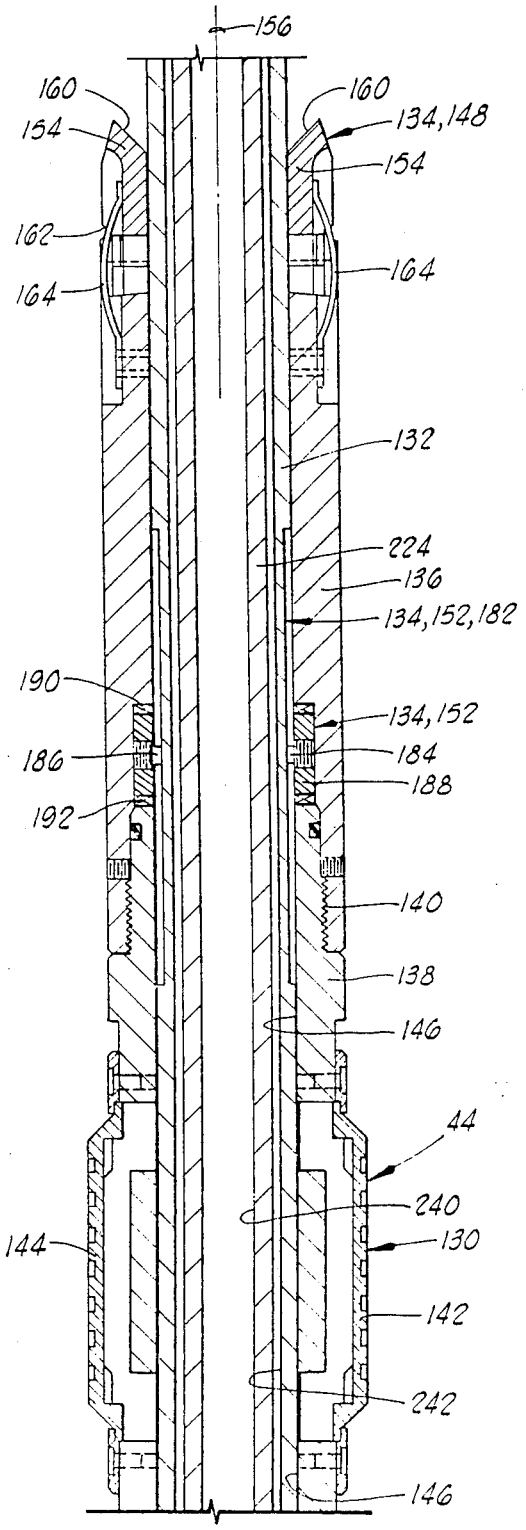
Figure 3C:
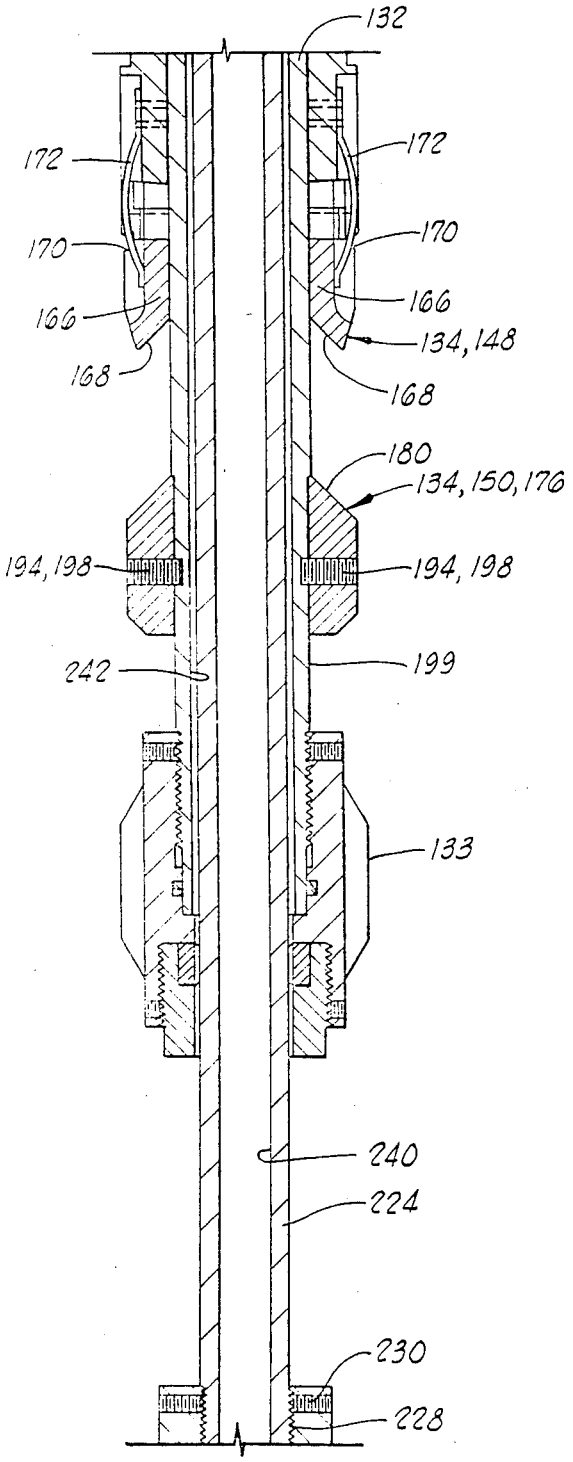
Figure 3D:
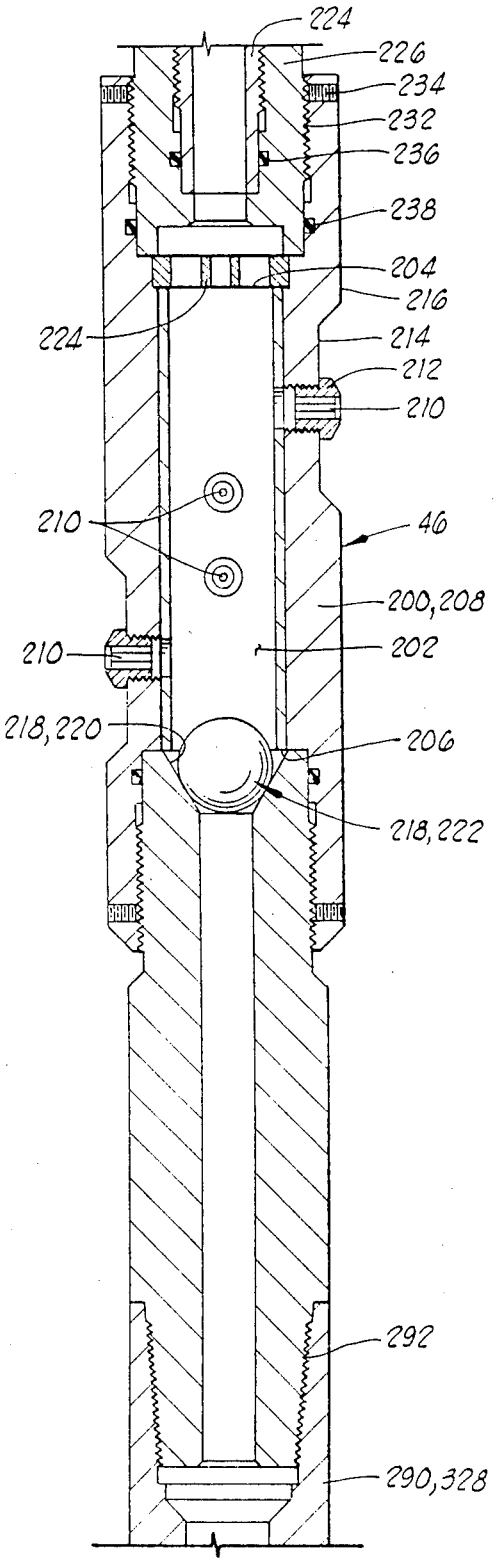
Figure 3E:
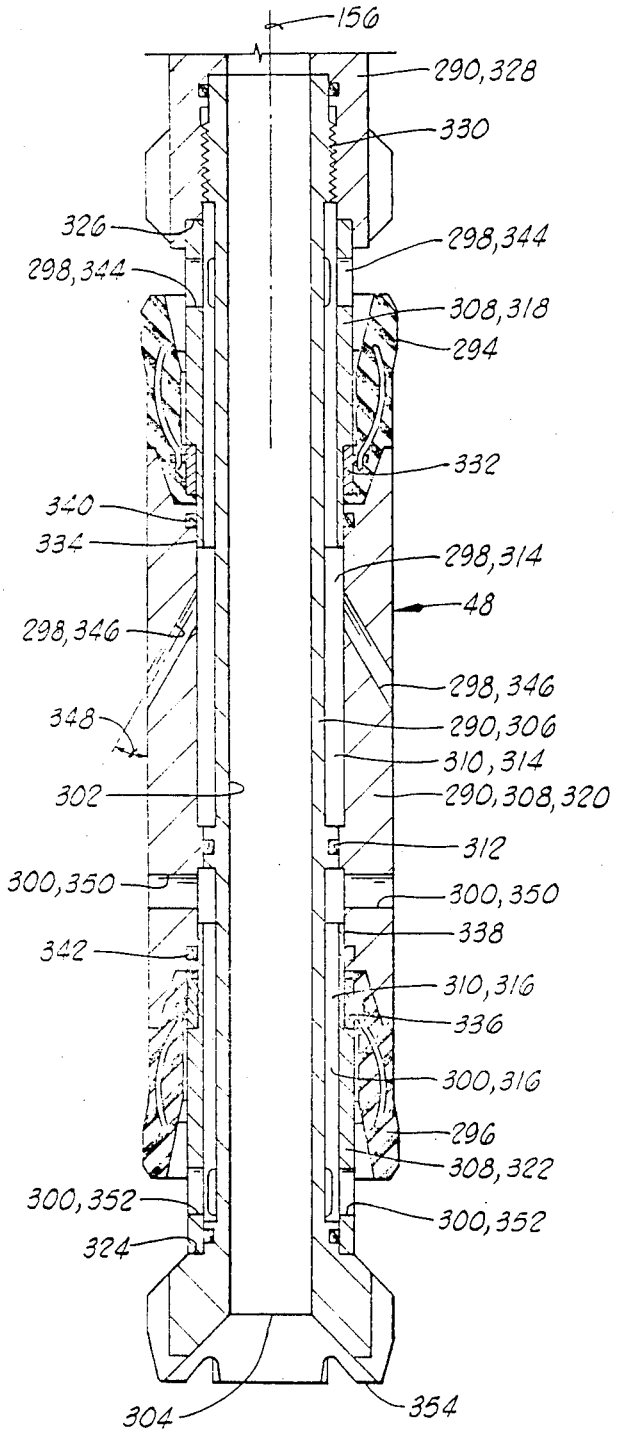

The swivel 201 best seen in FIG. 3A can be described as a swivel means 201 for providing the mentioned rotatable connection between the positioning tool 44 and the jetting tool 46, and for connecting the positioning tool 44 and jetting tool 46 for common longitudinal movement relative to the well 10.

The jetting tool 46 further includes a rotatable jetting mandrel 224 fixedly attached to the jetting sub 200 through a connector 226. The connector 226 is threadedly connected to jetting mandrel 224 at thread 228 with set screws 230 maintaining the fixed connection. The connector 226 is fixedly connected to jetting sub 200 at threaded connection 232 with the connection being maintained by set screws 234. An O-ring seal 236 is provided between jetting mandrel 224 and connector 226, and an O-ring seal 238 is provided between connector 226 and jetting sub 200.

Thus, the jetting mandrel 224 is fixedly attached to the jetting sub 200 by connector 226, so that the jetting mandrel 224 and jetting sub 200 rotate together relative to the positioning tool 44.

The jetting mandrel 224 has a jetting mandrel bore 240 defined therethrough which is communicated with the chamber 202 of jetting sub 200.

The jetting mandrel 224 is concentrically and rotatably received through a bore 242 of the positioning mandrel 132 of positioning tool 44.

The jetting mandrel 224 extends upward all the way through the positioning tool 44 to the swivel 201.

The swivel 201 includes a swivel housing 244 which is connected to an upper end of the positioning mandrel 132 at threaded connection 246 with set screws 248 maintaining the connection. An O-ring seal 250 is provided between swivel housing 244 and the positioning mandrel 132. The swivel housing 244 is made up of a lower housing section 252 and an upper housing section 254 connected at threaded connection 256.

The lower and upper housing sections 252 and 254 define an inner annular recess 258 of the swivel housing 244.

The jetting mandrel 224 includes an upper jetting mandrel extension 260 connected to the lower jetting mandrel portion at thread 262. The upper jetting mandrel extension has an outer annular shoulder 264 defined thereon, which is received in the annular recess 258 of swivel housing 244.

Upper and lower thrust bearings 266 and 268 are disposed in the annular recess 258 above and below the annular shoulder 264. The upper thrust bearing 266 has an outer race 270 fixed to the swivel housing 244 and an inner race 272 fixed to the jetting mandrel extension 260. The lower thrust bearing 268 includes an outer race 274 fixed to the swivel housing 244, and an inner race 276 fixed to the jetting mandrel 224.

An upper end portion 278 of jetting mandrel extension 260 extends through the upper end of upper swivel housing section 254 with an O-ring seal 280 being provided therebetween.

An upper adapter 282 is connected at thread 284 to the upper end portion 278 of jetting mandrel extension 260, with an O-ring seal 286 being provided therebetween. The upper adapter 282 includes threads 288 for connection to the tubing string 36 of FIG. 1 so that the tubing string 36 is in fluid communication with the bore 240 of the jetting mandrel 224.

The Disintegratable Inserts

As mentioned above, the preferred design for the disintegratable plugs 96 and 98 is to have a hollow externally threaded insert ring 120 or 122 filled with a disintegratable material, which preferably is Cal Seal available from U.S. Gypsum Company. Cal Seal is a calcium sulfate cement which has a bearing strength, i.e., yield strength, of approximately 2500 psi. This material can be readily disintegrated by a hydraulic jet of clear water at pressures of 4,000 psi or greater, which can be readily supplied with conventional tubing strings. The hydraulic jetting of plugs constructed from Cal Seal is preferably done at hydraulic pressures in a range of from about 4,000 psi to about 5,000 psi.

Typical conventional tubing strings 36 can convey hydraulic pressures up to about 12,000 psi. Thus, in order to utilize a conventional tubing string with the tools of the present invention, it is desirable that the disintegratable plugs be constructed of a material having a bearing strength sufficiently low that said material can be readily disintegrated by a hydraulic jet of water at a pressure of no greater than about 12,000 psi. Such materials can then be disintegrated by the tools of the present invention, utilizing a tubing string of conventional strength, without the need for use of any abrasive materials or of acids or other volatile substances.

It will be appreciated that the clear fluids preferably utilized to jet the plugs out of the communication port are "clear" only in a relative sense. It is only meant that they do not contain any substantial amount of abrasive materials for the purpose of abrading the plugs, nor do they need to contain acids or the like. Thus, the preferred plug material is defined as material which as a bearing strength such that it can be readily disintegrated by a hydraulic jet of water at a pressure of no greater than about 12,000 psi. Such plugs can, of course, also be disintegrated with hydraulic jets which do contain abrasive materials or substances such as acid.

Most materials when subjected to a hydraulic jet of plain water will exhibit a "threshold pressure" which is the hydraulic pressure required to readily disintegrate or cut the material with the hydraulic jet. At pressures below this threshold there is little disintegration. At pressures significantly above the threshold the material readily disintegrates. There is no significant advantage of further raising the pressure to values greatly above this threshold.

The value of this "threshold pressure" for a given material depends somewhat upon the nature of the material. In any event, however, the threshold pressure is always greater than the bearing strength of the material.

For example, for a calcium sulfate cement such as Cal Seal, having a bearing strength of 2500 psi, the material will readily disintegrate under a hydraulic jet of water at a hydraulic pressure of about 4,000 psi. At such pressures a Cal Seal plug will disintegrate in a matter of a few minutes.

In view of the maximum pressure typically available through a conventional tubing string, i.e., a hydraulic pressure of no more than about 12,000 psi, materials should be used for the disintegratable plugs having a bearing strength of less than about 5,000 psi. These materials can generally be cut by jets at a hydraulic pressure of 12,000 psi or less. If cement type materials are used, those materials will generally have a bearing strength of less than about 3500 psi.

A number of materials other than the Cal Seal brand calcium sulfate cement are believed to be good candidates for use for construction of the disintegratable plugs in some situations. Properly formulated Portland cement which has bearing strength in the range from 1,000 to 3,500 psi, depending upon its formulation, age, etc., will be usable in some instances. Some plastic materials could be utilized. Also, composites such as powdered iron or other metal in an epoxy carrier are possible candidates.

The Wash Tool

The wash tool 48 can be generally described as an apparatus to be run on the tubing string 36 to clean out the casing bore 13. Wash tool 48 includes a wash tool housing 290 having a thread 292 at its upper end which may be generally described as a connector means 292 for connecting the housing 290 to the tubing string 36 by way of the other tools located therebetween.

Wash tool 48 includes an upper packer means 294 connected to the housing 290 for sealing between the housing 290 and the casing bore 13.

Figure 4D:
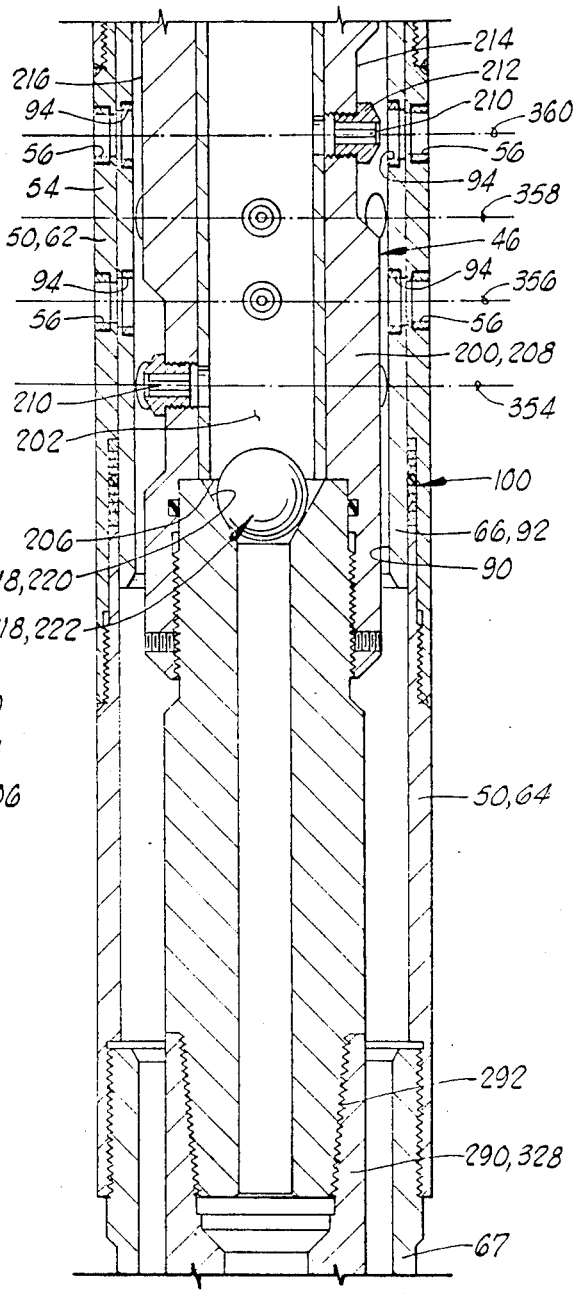
Figure 4E:
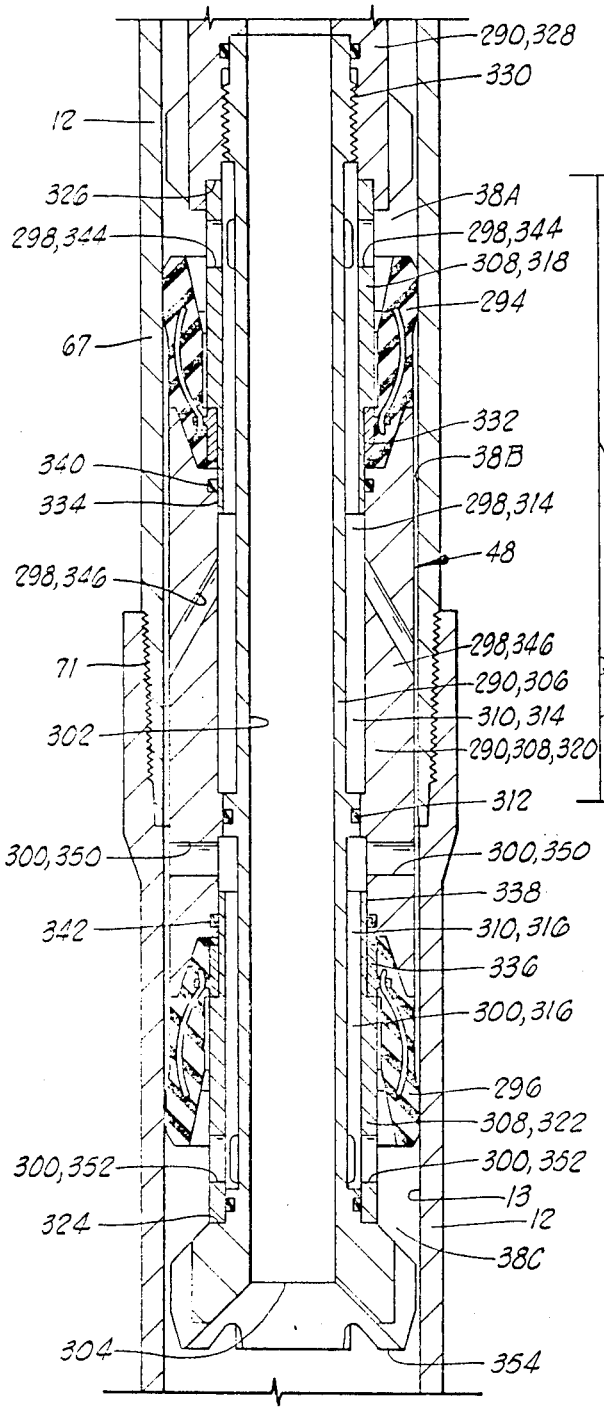

The upper packer means 294 is shown in FIG. 4E in place within the casing 12. It is there seen that the upper packer means 294 defines an upper portion 38A of well annulus 38 above the upper packer means 294.

The wash tool 48 further includes a lower packer means 296 connected to the housing 290 below the upper packer means 294 for sealing between the housing 290 and the casing bore 13 and for defining an intermediate portion 38B of well annulus 38 between the upper and lower packer means 294 and 296, and for defining a lower portion 38C of well annulus 38 below the lower packer means 296.

The housing 290 has an upper fluid bypass means 298 defined therein for communicating the upper portion 38A and the intermediate portion 38B of the well annulus so that fluid pumped down the well annulus 38 is bypassed around the upper packer means 294 and directed into the intermediate portion 38B of well annulus 38 to wash the casing bore 13 in the intermediate portion 38B of the well annulus.

The housing 290 also has a lower fluid bypass means 300 defined therein for communicating the intermediate portion 38B and the lower portion 38C of the well annulus 38 so that fluid is bypassed from the intermediate portion 38B of the well annulus around the lower packer means 296 and directed into the lower portion 38C of the well annulus to wash the casing bore 13 below the lower packer means 296.

The housing 290 also has a longitudinal housing bore 302 defined therethrough having an open lower end 304 so that fluid in the lower portion 38C of the well annulus may return up through the wash tool housing bore 302 and the tubing string 36 to carry debris such as cement particles and the like out of the casing bore 13.

The upper packer means 294 is an upwardly facing packer cup 294, and the lower packer means 296 is a downwardly facing packer cup 296.

The wash tool housing 290 includes an inner mandrel housing section 306 having the longitudinal bore 302 defined therethrough.

Housing 290 also includes a packer mandrel assembly 308 concentrically disposed about the inner mandrel housing section 306 and defining a tool annulus 310 therebetween. A seal means 312 is provided between the inner mandrel housing section 290 and the packer mandrel assembly 308 for dividing the tool annulus 310 into an upper tool annulus portion 314 and a lower tool annulus portion 316 which are part of the upper and lower bypass means 298 and 300, respectively.

The packer mandrel assembly 308 includes an upper packer mandrel 318, an intermediate packer mandrel 320 and a lower packer mandrel 322.

The inner mandrel housing section 306 includes an upward facing annular support shoulder 324 near its lower end on which the lower packer mandrel 322 is supported. The upper packer mandrel 318 is received in a recessed annular groove 326 of an upper nipple 328 of wash tool housing 290.

The nipple 328 and the inner mandrel housing section 306 are threadedly connected at 330 and the packer mandrel assembly 308 and upper and lower packer cups 294 and 296 are held tightly in place therebetween.

The upper packer cup 294 has an anchor ring portion 332 disposed about a reduced diameter outer surface 334 of upper packer mandrel 318 and sandwiched between the upper packer mandrel 318 and the intermediate packer mandrel 320.

The lower packer cup 296 has an anchor ring portion 336 disposed about a reduced diameter outer surface 338 of lower packer mandrel 322 and sandwiched between intermediate packer mandrel 320 and lower packer mandrel 322.

An O-ring seal 340 is provided between upper packer mandrel 318 and intermediate packer mandrel 320, and an O-ring seal 342 is provided between intermediate packer mandrel 320 and lower packer mandrel 322.

The upper fluid bypass passage means 298 of housing 290 includes a plurality of supply ports 344 disposed through the upper packer mandrel to communicate the upper well annulus portion 38A with the upper tool annulus portion 314. Upper fluid bypass passage means 298 further includes a plurality of jet ports 346, which may also be referred to as upper wash ports 346, disposed through the intermediate packer mandrel 320 to communicate the upper tool annulus portion 314 with the intermediate portion 38B of the well annulus. The jet ports 346 are downwardly directed at an acute angle 348 to the longitudinal axis 156 of the inner mandrel housing section 306.

The lower fluid bypass passage means 300 includes a plurality of return ports 350 disposed through the intermediate packer mandrel 320 below the jet ports 346 to communicate the intermediate well annulus 38B with the lower tool annulus portion 316. Lower fluid bypass passage means 300 further includes a plurality of lower wash ports 352 disposed through the lower packer mandrel 322 to communicate the lower tool annulus portion 316 with the lower portion 38C of the well annulus.

The jet ports 346 provide a means for directing jets of fluid against the casing bore 13 in the intermediate portion 38B of the well annulus. The jet ports are downwardly directed at the acute angle 348 so that debris washed from the casing bore 13 in intermediate well annulus portion 38B is washed downwardly toward the return ports 350.

The inner mandrel housing section 306 of wash tool housing 290 includes a plurality of teeth 354 defined on a lower end thereof so that upon rotation of the housing 290, the teeth 254 will break up debris, such as residual cement, in the casing bore 13.

The wash tool 48 is used in the following manner. As the tool is lowered through casing string 12 it is rotated by rotating the tubing string 36. Simultaneously, fluid is pumped down the well annulus 38.

The rotating teeth 354 break debris loose in a portion of the casing bore. Well fluid circulated down through the casing annulus 38 bypasses the upper and lower packer cups 294 and 296 through the bypass passage means 298 and 300, respectively, and exits the lower wash ports 352 to wash away the debris created by the rotating teeth 354 and to reverse circulate that debris with the well fluid up through the longitudinal housing bore 302 and the tubing string 36.

After that portion of the bore initially engaged by the teeth 354 is washed by the lower wash ports 352, the lower packer cup 296 wipes that portion of the casing bore 13 as the wash tool 48 is advanced downwardly through the casing string 12.

That portion of the casing bore 13 which has been wiped by the lower packer cup 296 is then jet washed by fluid exiting the jet ports or upper wash ports 346.

The method just described is a continuous method wherein debris is being broken loose and reverse circulated up the well from one portion of the casing bore, while another portion of the casing bore is being wiped, and yet another portion of the casing bore is being jet washed. These steps are performed simultaneously on different portions of the casing bore, and in the order mentioned on each respective portion of the casing bore.

Further, it is noted that the well fluid which jet washes one portion of the casing bore as it exits the jetting ports 346 is used subsequently in time to reverse circulate debris out of a lower portion of the casing bore which is adjacent the lower wash ports 352.

Methods Of Operation

The use of the casing valve 24 in highly deviated well bore portions 22 along with the tool string shown in FIGS. 3A–3E provides a system for the completion of highly deviated wells which will substantially reduce completion costs in such wells by eliminating perforating operations, and by eliminating the need for establishing zonal isolation through the use of packers and bridge plugs. In general, this system will provide substantial savings in rig time incurred during completion of the well.

Completion of the well 10 utilizing this system begins with the cementing of the production casing string 12 into the well bore 14 with cement as indicated at 16. Particularly, the well is cemented across the zones of interest in which casing valves such as 24, 26 and 28 have been located prior to running the casing string 12 into the well. With this system, a casing valve such as 24 is located at each point at which the well 10 is to be stimulated adjacent some subsurface formation of interest such as the subsurface formations 30, 32 and 34. These points of interest have been previously determined based upon logs of the well and other reservoir analysis data. The casing string or liner string 12 containing the appropriate number of casing valves such as 24 is centralized and cemented in place within the well bore 14 utilizing acceptable practices for cementing in horizontal hole applications.

After cementing, a bit and stabilizer trip should be made to clean and remove as much as possible of the residual cement laying on the bottom of the casing 12 in the horizontal section 22. The bit size utilized should be the largest diameter bit that can be passed safely through the casing string 12. After cleaning out to total depth of the well by drilling out residual cement, the fluid in the casing string 12 should be changed over to a filtered clear completion fluid suitable for use in completing the well if this has not already been done when displacing the final cement plug during the cementing process.

The next trip into the well is with the tool string of FIGS. 3A–3E including positioning tool 44, jetting tool 46 and wash tool 48, as is schematically illustrated in FIG. 1. In FIG. 1, this tool assembly is shown as it is being initially lowered into the vertical portion 18 of well 10. The tool assembly will pass through the radiused portion 20 and into the horizontal portion 22 of the well 10. The tool assembly should first be run to just below the lowermost casing valve 28.

Then, hydraulic jetting begins utilizing a filtered clear completion fluid. The hydraulic jetting is performed with the jetting tool 46 by pumping fluid down the tubing string 36 and out the jetting orifices 210 so that high pressure jets of fluid impinge upon the casing bore 13. The tubing string 36 will be rotated while the jetting tool 46 is moved upward through the casing valve 28 to remove any remaining residual cement from all of the recesses in the internal diameter of the casing valve 28. This is particularly important when casing valve 28 is located in a deviated well portion because significant amounts of cement will be present along the lower inside surfaces of the casing valve 28. This cement must be removed to insure proper engagement of positioning tool 44 with sleeve 66. During this jetting operation, the positioning tool 44 should be indexed to one of its intermediate positions such as represented by lug position 104B or 104F so that the positioning tool 44 can move upward through casing valve 28 without engaging the sliding sleeve 66 of casing valve 28.

It is noted that when the terms "upward" or "downward" are used in the context of a direction of movement in the well, those terms are used to mean movement along the axis of the well either uphole or downhole, respectively, which in many cases will not be exactly vertical and can in fact be horizontal in a horizontally oriented portion of the well.

After hydraulically jetting the internal bore of the casing valve 28, the positioning tool 44 is lowered back through the casing valve 28 and indexed to the position represented by lug position 184D. The positioning tool 44 is pulled upward so that the lower wedge 176 engages the lower engagement blocks 166 to cam them radially outward so their upward facing shoulders 170 engage shoulder 126 of sliding sleeve 66. The tubing string 36 is pulled upward to apply an upward force of approximately 10,000 pounds to the sliding sleeve 66 of casing valve 28. The internal collet 76 which is initially in engagement with the first groove 78 of valve housing 50 will compress due to the 10,000 pound upward pull and release the first groove 78. As the internal collet 76 compresses and releases a decrease in upward force will be noted at the surface to evidence the beginning of the opening sequence. The sliding sleeve 66 will continue to be pulled to its full extent of travel which will be confirmed by a sudden rise in weight indicator reading at the surface as the top of the sliding sleeve 66 abuts the bottom end 63 of the upper handling sub 65 as shown in FIG. 4B. At this point the collet 76 will engage second latch groove 80.

At this time, upward pull on the tubing string is reduced to maintain approximately 5,000 to 8,000 pounds upward force on the opening blocks 166. While maintaining that upward pull, and thus maintaining opening blocks 166 in operative engagement with shoulder 126 of sliding sleeve 66, rotation of the work string 36 begins maintaining the slowest rotary speed possible. As the tubing string 36 rotates, so does the jetting tool 46 which is connected to the tubing string 36 by the jetting mandrel 224. While slowly rotating the work string 36 and the jetting tool 46, high pressure fluid is pumped down the tubing string 36 and directed out the jetting ports 210.

When the sliding sleeve 66 slides upward to its open position as just described, each of the sleeve communication ports 94 is placed in registry with a respective one of the housing communication ports 56 as seen in FIG. 4D. Also, the jet orifices 210 of jetting tool 46 are aligned with a plurality of longitudinally spaced planes 354, 356, 358 and 360 (see FIG. 4D) in which the sleeve ports 56 and housing ports 94 lie. The planes 354 through 360 shown in FIG. 4D are shown on edge and extend perpendicularly out of the plane of the paper on which FIG. 4D is drawn.

The jetting tool 46 is rotated while maintaining the jetting orifices 210 in alignment with the planes 354–360 so that the disintegratable plugs 96 and 98 initially located in the housing communication ports 56 and sleeve communication ports 94 are repeatedly contacted by the high velocity fluid streams from the jet orifices 210 to disintegrate the plugs.

After hydraulically jetting the plugs for sufficient time to remove the port plugging material, the blowout preventers 40 (see FIG. 1) may be closed and the well 10 may be pressurized to pump fluid into the formation 34 adjacent casing valve 28 to confirm plug removal if desired and feasible based upon anticipated formation breakdown pressures and pressure limitations of the blowout preventers 40 and casing string 12.

Once the jetting of the plugs has been completed and the pressure testing has been completed, the positioning tool 44 is indexed to a position represented by lug position 184A wherein the positioning mandrel 132 slides downward relative to drag means 130 until the upper wedge 174 engages the closing blocks 154. As the positioning tool 44 moves downward through casing valve 28, the closing blocks 154 will be cammed outward and their downward facing shoulders 162 will engage shoulder 128 of sliding sleeve 66. Then approximately 10,000 pounds downward force is applied to the sliding sleeve 66 to cause the collet 76 to collapse and move out of the engagement with upper groove 80. The sleeve 66 will then slide downward until collet 76 engages the lower groove 78 and the valve is once again in the position as shown in FIGS. 2A–2E, except that the plugs have now been disintegrated and removed from the sleeve ports 94 and housing ports 56.

If desired, the blowout preventers 40 can again be closed and the casing can be pressure tested to confirm that the casing valve 28 is in fact closed.

Then, the tool string is moved upward to the next lowest casing valve such as casing valve 26 and the sequence is repeated. After casing valve 26 has been treated in the manner just described, the tool string is again moved upward to the next lower casing valve until finally all of the casing valves have been hydraulically jetted to remove residual cement, and have then been opened and had the plugs jetted therefrom, and then the valves have been reclosed.

Once all of the casing valves have been jetted out and reclosed, the work string should be pulled up to the top of the liner, or to the top of the deviated section 22 of the casing 12 and backwashed. Backwashing is accomplished by reverse circulation down the well annulus 38 through the bypass passages 298 and 300 of wash tool 48 and back up the bore 302 of wash tool 48 and up through the tubing string 36. The casing is backwashed in a downward direction while moving the tool string down through the well until the casing has been backwashed down to its total depth to remove all debris residual from the hydraulic jetting operation, in preparation for primary stimulation. Once backwashing is complete, the work string will be withdrawn from the well to change over to the required tool assembly for a stimulation operation, e.g., a fracturing operation.

FIG. 6 illustrates a stimulation tool string, which in this case is a fracturing tool string in place within the well 10. The work string for fracturing operations includes the wash tool 48 attached to the bottom of the positioning tool 44 which is located below a packer 362 all of which is suspended from the tubing string 36. Other auxiliary equipment such as safety valves or the like may also be located in the work string.

The work string illustrated in FIG. 6 is run to the bottom of the casing string 12 and the lowermost casing valve 28 is engaged with a positioning tool 44 to move the sliding sleeve 66 of casing valve 28 to an open position wherein its sleeve communication ports 94 are in registry with its housing communication ports 56. The ports have already had their plugs jetted out, so when the sleeve 66 is moved to this open position, the interior of casing string 12 is communicated through the open ports 94 and 56 with the surrounding formation 34.

Then, the positioning tool 44 is disengaged from the sliding sleeve 66 and the work string is raised to a desired point above the sleeve valve 28, at which the packer 362 is set. Then, the zone 34 is stimulated as desired. With the fracturing string, a fracturing fluid will be pumped through the ports of casing valve 28 into the surrounding formation to form fractures 364. It will be appreciated that many other types of stimulation operations can be performed on the formation 34 through the casing valve 28, such as acidizing procedures and the like.

After stimulation, the zone 34 may be cleaned up and tested as desired producing back up through the tubing string 36. After testing, the zone 34 is killed to maintain well control, and the packer 362 is unset. Then, the casing bore 12 and the interior of casing valve 28 are again backwashed through the wash tool 48 to remove fracturing sand and formation fines from the interior of casing 12 and from the interior of the casing valve 28. The casing valve 28 is then again engaged with the positioning tool 44 and the sliding sleeve 66 thereof is moved to a closed position.

Afterwards, the work string is moved up to the next lowest casing valve 26 and the process is repeated to fracture the formation 32, then backwash the casing valve 26 and then reclose the casing valve 26. Then the work string is moved up to the next casing valve 24 and the operation is again repeated.

After completing all of the subsurface formations 30, 32 and 34, the casing valves 24, 26 and 28 may be reopened, selectively if desired, in preparation for running a production packer or whatever production string hookup is to be used, and the frac string shown in FIG. 6 is then withdrawn from the well.

Figure 7:
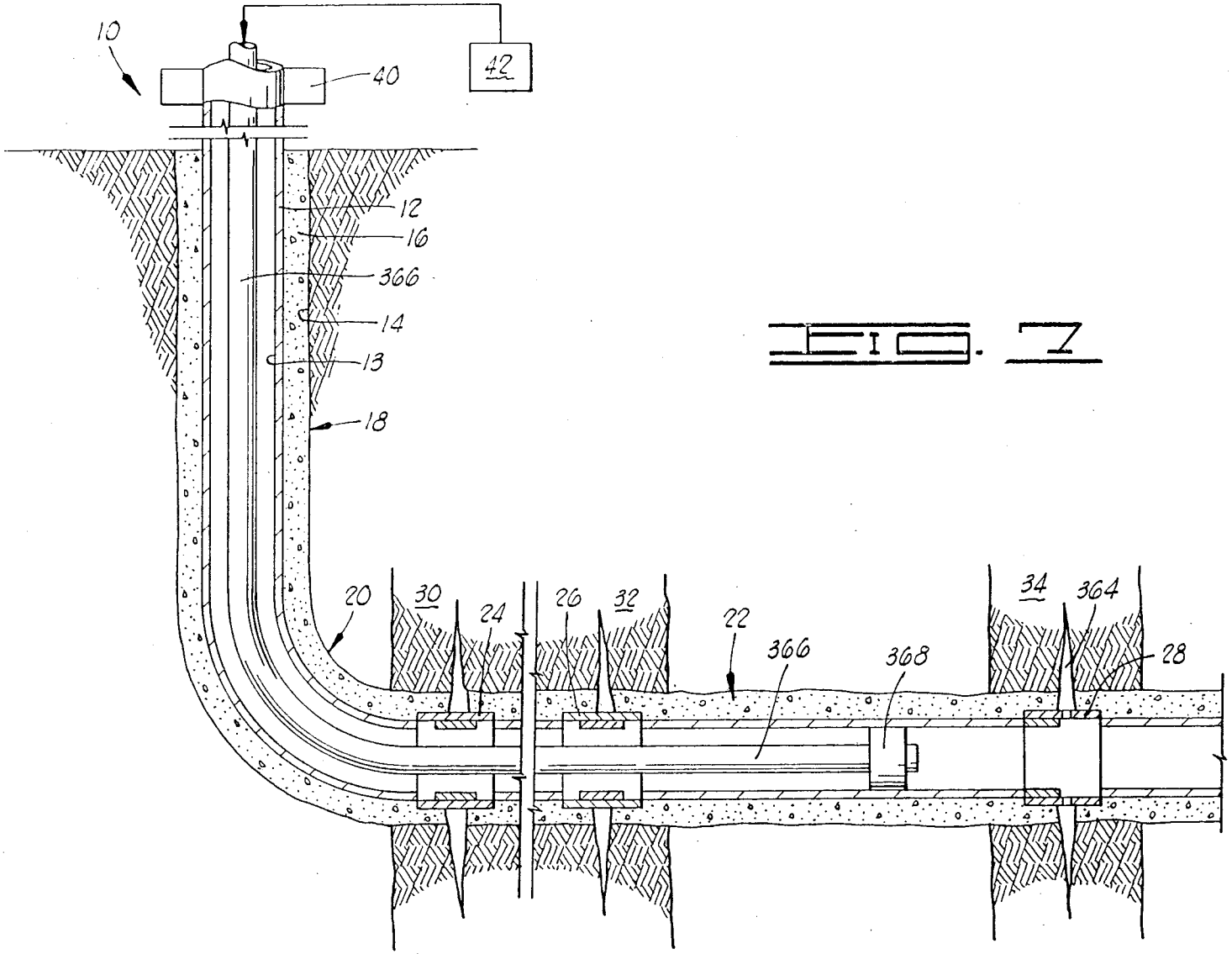
FIG. 7 is a view similar to FIG. 1 with a production tubing string in place producing formation fluids through a lowermost one of the casing valves.

FIG. 7 schematically illustrates a selective completion of only the lower zone 34 of well 10. Prior to removing the work string shown in FIG. 6, the sliding sleeve 66 of the lowermost casing valve 28 has been moved to an open position. Then, after removal of the work string shown in FIG. 6, a production tubing string 366 and production packer 368 are run into place and set above the lower casing valve 28. Production of well fluids from subsurface formation 34 is then performed through the casing valve 28 and up through the production string 366.

Thus it is seen that the present invention readily achieves the ends and advantages mentioned as well as those inherent therein. While certain preferred embodiments of the invention have been illustrated and described for purposes of the present disclosure, numerous changes may be made by those skilled in the art, which changes are encompassed within the scope and spirit of the appended claims.

What is claimed is:

1. A positioning tool apparatus for positioning a sliding member of a well tool, comprising:

a drag assembly having a longitudinal passageway defined therethrough;

an inner mandrel disposed through said longitudinal passageway of said drag assembly and longitudinally movable relative to said drag assembly; and operating means for selectively operably engaging the sliding member of the well tool in response to longitudinally reciprocating motion of said inner mandrel relative to said drag assembly, said well tool and said sliding member thereof being separate from said positioning tool apparatus.

2. The apparatus of claim 1, wherein said operating means comprises:

engagement means, connected to said drag assembly, for operably engaging the sliding member of the well tool;

actuating means, connected to said inner mandrel, for actuating said engagement means so that said engagement means can operably engage the sliding member; and a position control means, operably associated with said drag assembly and said inner mandrel, for permitting said inner mandrel to reciprocate longitudinally relative to said drag assembly and selectively actuate and unactuate said engagement means with said actuating means.

3. The apparatus of claim 2, wherein said engagement means comprises:

a first plurality of engagement blocks circumferentially spaced about a longitudinal axis of said drag assembly, each of said engagement blocks having a tapered camming surface defined on one end thereof, and each of said blocks also having an engagement shoulder defined thereon and facing away from said one end; and a first biasing means for resiliently biasing said first plurality of engagement blocks radially inward toward said longitudinal axis of said drag assembly.

4. The apparatus of claim 3, wherein:

said actuating means includes a first annular wedge having a tapered annular wedging surface complementary to said tapered camming surfaces of said engagement blocks, said annular wedge being positioned on said inner mandrel so that when said inner mandrel is moved to a first longitudinal position relative to said drag assembly, said annular wedging surface wedges against said tapered camming surfaces and cams said blocks radially outward.

5. The apparatus of claim 4, wherein said engagement means further comprises:

a second plurality of engagement blocks circumferentially spaced about said longitudinal axis of said drag assembly, each of said second blocks having a tapered camming surface defined on one end thereof facing away from said first plurality of engagement blocks, and each block of said second plurality of engagement blocks having an engagement shoulder defined thereon and facing toward said first plurality of engagement blocks; and a second biasing means for resiliently biasing said second plurality of engagement blocks radially inward toward said longitudinal axis of said drag assembly.

6. The apparatus of claim 5, wherein:

said actuating means further includes a second annular wedge having a tapered annular wedging surface complementary to said tapered camming surfaces of said second plurality of engagement blocks; and said tapered annular wedging surfaces of said first and second annular wedges face toward each other with said first and second pluralities of engagement blocks being located between said first and second annular wedges.

7. The apparatus of claim 3, wherein said engagement means further comprises:

safety retainer means for maintaining a connection between each of said engagement blocks and said drag assembly in the event of breakage of said first biasing means.

8. The apparatus of claim 2, wherein:

said engagement means includes separate first and second engagement means; and said actuating means includes first and second annular wedges having first and second tapered wedging surfaces, respectively, facing toward each other with said first and second engagement means located therebetween.

9. The apparatus of claim 2, wherein said position control means comprises:

a J-slot defined in one of said inner mandrel and said drag assembly; and a lug connected to the other of said inner mandrel and said drag assembly, said lug being received in said J-slot.

10. The apparatus of claim 9, wherein:

said J-slot is defined in said inner mandrel; and said lug is connected to said drag assembly.

11. The apparatus of claim 9, wherein said J-slot is an endless J-slot.

12. The apparatus of claim 9, wherein:

one of said drag assembly and said inner mandrel includes a rotatable ring having its respective one of said J-slot and said lug defined on said ring to permit relative rotation between said J-slot and said lug upon relative longitudinal movement between said drag assembly and said inner mandrel.

13. The apparatus of claim 2, wherein:

said engagement means includes:

a first engagement means, connected to said drag assembly, for engaging the sliding member of the well tool to move the sliding member in a first direction; and a second engagement means, connected to said drag assembly and longitudinally spaced from said first engagement means, for engaging the sliding member of the well tool to move the sliding member in a second direction;

said actuating means includes:

a first actuating means, connected to said inner mandrel, for actuating said first engagement means, when said mandrel is in a first longitudinal position relative to said drag assembly so that said first engagement means can operably engage the sliding member; and a second actuating means, connected to said inner mandrel, for actuating said second engagement means when said mandrel is in a second longitudinal position relative to said drag assembly so that said second engagement means can operably engage the sliding member; and said position control means is further characterized as a means for permitting said inner mandrel to move between its said first and second positions and at least one intermediate position in which said first and second engagement means are unactuated.

14. The apparatus of claim 13, wherein:

in said first and second longitudinal positions of said inner mandrel relative to said drag assembly, said first and second positions are defined by interaction of said first and second actuating means with said first and second engagement means, respectively, rather than by said position control means.

15. The apparatus of claim 14, wherein:

said at least one intermediate position of said inner mandrel relative to said drag assembly is positively defined by said position control means.

16. The apparatus of claim 13, wherein:

said position control means includes a J-slot and lug assembly interconnecting said inner mandrel and said drag means and defining, at least in part, a repetitive pattern of longitudinal positions of said inner mandrel relative to said drag assembly achievable upon longitudinal reciprocation of said inner mandrel relative to said drag assembly, said repetitive pattern including:

(a) said first longitudinal position;

(b) said at least one intermediate longitudinal position, the same being further characterized as a position in which said inner mandrel and said drag assembly can be moved longitudinally together in said second direction;

(c) another intermediate longitudinal position in which said inner mandrel and said drag assembly can be moved longitudinally together in said first direction with said first and second engagement means unactuated; and (d) said second longitudinal position.

17. The apparatus of claim 16, wherein:

said position control means is further characterized in that said repetitive pattern includes said positions (a), (b), (c), (d), (c) and (b) in that order.

18. The apparatus of claim 17, wherein:

said position control means is further characterized in that said repetitive pattern includes only said positions (a), (b), (c), (d), (c) and (b).

19. The apparatus of claim 16, wherein:

said two intermediate longitudinal positions are positively defined by abutment of said lug with said J-slot; and said first and second longitudinal positions are permitted by said J-slot and lug assembly and are positively defined by interaction of said first and second actuating means with said first and second engagement means, respectively.

20. The apparatus of claim 13, further comprising:

emergency release means, operatively associated with each of said first and second actuating means, for releasing said first and second engagement means from operative engagement with the sliding member without moving said inner mandrel to said intermediate position.

21. The apparatus of claim 20, wherein:

said emergency release means includes first and second shear pins connecting said first and second actuating means, respectively, to said inner mandrel.

22. The apparatus of claim 2, further comprising:

emergency release means, operatively associated with said actuating means, for releasing said engagement means from operative engagement with the sliding member in the event said position control means is disabled.

23. The apparatus of claim 1, wherein:

said inner mandrel includes centralizer means for centralizing said apparatus within the well tool.

24. A positioning apparatus for a well tool, comprising drag assembly having an upper end and a lower end and having a longitudinal passageway disposed therethrough;

a radially inwardly biased upper engagement block carried by said upper end of said drag assembly;

a radially inwardly biased lower engagement block carried by said lower end of said drag assembly;

an inner mandrel slidably received through said longitudinal passageway of said drag assembly;

an upper wedge attached to said inner mandrel above said upper engagement block;

a lower wedge attached to said inner mandrel below said lower engagement below said lower engagement block; and a J-slot and lug means, interconnecting said inner mandrel and said drag assembly, for selectively permitting said mandrel to move relative to said drag assembly between a first position wherein said upper wedge cams said upper engagement block radially outward and a second position wherein said lower wedge cams said lower engagement block radially outward.

25. The apparatus of claim 24, wherein:

said J-slot and lug means is further characterized as a means for selectively permitting said mandrel to move to third and fourth positions relative to said drag assembly wherein said mandrel and said drag assembly move longitudinally together upwardly and downwardly, respectively, without relative longitudinal motion therebetween and without engaging either of said engagement blocks with said wedges.

26. The apparatus of claim 25, wherein:

said J-slot and lug means defines in part a repetitive pattern of longitudinal positions of said inner mandrel relative to said drag assembly achievable upon longitudinal reciprocation of said inner mandrel relative to said drag assembly.

27. The apparatus of claim 26, wherein:

said repetitive pattern includes said first, second, third and fourth positions in the order first position, third position, fourth position, second position, fourth position and third position.

28. The apparatus of claim 27, wherein:

said J-slot and lug means is further characterized in that said repetitive pattern includes only said first, third, fourth, second, fourth and third positions.

29. The apparatus of claim 25, wherein:

said third and fourth positions are positively defined by abutment of said lug with said J-slot.

30. The apparatus of claim 24, wherein:

said J-slot is defined in said inner mandrel; and said lug is connected to said drag assembly.

31. The apparatus of claim 24, wherein said J-slot is a endless J-slot.

32. The apparatus of claim 24, wherein:

one of said drag assembly and said inner mandrel includes a rotatable ring having its respective one of said J-slot and said lug defined on said ring to permit relative rotation between said J-slot and said lug upon relative longitudinal movement between said drag assembly and said inner mandrel.

33. The apparatus of claim 24, further comprising:

emergency release means, operatively associated with each of said upper and lower wedges, for releasing said upper and lower wedges from rigid attachment to said inner mandrel.

34. The apparatus of claim 33, wherein:

said emergency release means includes upper and lower shear pins connecting said upper and lower wedges, respectively, to said inner mandrel.

35. The apparatus of claim 24, wherein:

said inner mandrel includes centralizer means for centralizing said apparatus within a well bore.

* * * * *